US010892535B2

(12) United States Patent
Li

(10) Patent No.: US 10,892,535 B2
(45) Date of Patent: Jan. 12, 2021

(54) VERTICAL TRANSITION METHOD APPLIED BETWEEN COAXIAL STRUCTURE AND MICROSTRIP LINE

(71) Applicant: NATIONAL TAIPEI UNIVERSITY OF TECHNOLOGY, Taipei (TW)

(72) Inventor: Eric S. Li, Taipei (TW)

(73) Assignee: NATIONAL TAIPEI UNIVERSITY OF TECHNOLOGY, Taipei (TW)

( * ) Notice: Subject to any disclaimer, the term of this patent is extended or adjusted under 35 U.S.C. 154(b) by 0 days.

(21) Appl. No.: 16/396,927

(22) Filed: Apr. 29, 2019

(65) Prior Publication Data

US 2019/0341666 A1 Nov. 7, 2019

(30) Foreign Application Priority Data

May 2, 2018 (TW) ..... 107114873 A

(51) Int. Cl.
*H01P 3/08* (2006.01)
*H01P 3/06* (2006.01)

(52) U.S. Cl.
CPC ..... *H01P 3/081* (2013.01); *H01P 3/06* (2013.01)

(58) Field of Classification Search
CPC ..... H01P 3/081; H01P 3/06
See application file for complete search history.

(56) References Cited

U.S. PATENT DOCUMENTS 6,236,287 B1 * 5/2001 Quan ..... H01P 5/085 333/260

* cited by examiner

*Primary Examiner* — Samuel S Outten
(74) *Attorney, Agent, or Firm* — Bacon & Thomas, PLLC

(57) ABSTRACT

A method for a vertical transition between a coaxial structure and a microstrip line features a slot in the ground plane of the microstrip line and near one end of its signal line. Multiple through holes are created at the substrate within the slot. The multiple through holes include a transition hole next to the end of the signal line, and at least a second hole. The transition hole and the slot are managed to establish a first eccentric configuration to achieve field transformation between the coaxial structure and the microstrip line, which would reduce the insertion loss of the vertical transition at higher frequencies and increase its 1-dB passband. The second hole and the slot are arranged to create a second eccentric configuration, and the second hole is used to relocate a resonance response caused by the slot towards higher frequencies to further increase the 1-dB passband.

10 Claims, 19 Drawing Sheets

Electric field

Magnetic field

VERTICAL TRANSITION METHOD APPLIED BETWEEN COAXIAL STRUCTURE AND MICROSTRIP LINE

BACKGROUND OF THE INVENTION

(1) Field of the Invention

The present invention relates to a method for a vertical transition, in particular, a vertical transition for high-frequency signal transmissions between a coaxial structure and a microstrip line.

(2) Description of the Prior Art

In the field of microwave communications, due to the requirements of device testing or the needs for system integration, there are situations in which vertical connections are desired between various transmission lines, such as coaxial cables, microstrip lines, coplanar waveguides, waveguides, etc. Among them, a vertical transition between a coaxial cable and a microstrip line is the most common connection. To facilitate the operations of testing and assembly, it is a common practice to attach a flange-mount coaxial connector to one end of a microstrip line vertically, and then to connect a coaxial cable to the connector to complete a vertical transition between the coaxial cable and the microstrip line.

As shown in FIG. 1A, a conventional flange mount SMA (Sub-Miniature version A) coaxial connector 100 includes an outer conductor 110, a mounting wall 120, a center conductor 130, and a dielectric body 140. The outer conductor 110 is used to connect and fix a coaxial cable 200. The mounting wall 120 can be considered as a part of the outer conductor 110 for mechanical assembly. The center conductor 130 is wrapped around by the dielectric body 140, with which the space between the center conductor 130 and the outer conductor 110 is filled. The mounting wall 120 is located at one of the longitudinal ends of the connector and is used to fully or partially attached any flat surface. One end of the center conductor 130 extends out of the interior of the dielectric body 140 and the mounting wall 120 as well to provide a connection to the signal line of a microstrip line.

In the configuration of a conventional rear-mounted vertical transition shown in FIG. 1A, the coaxial connector 100 is placed underneath the ground plane 350 of the microstrip line 300. To assemble the vertical transition, the center conductor 130 penetrates the through hole 312 created in the microstrip line 300. It passes through the ground plane 350 first, and then the substrate 310 from its lower side, and at last is connected to the signal line 330 to complete vertical transition. The conventional rear-mounted vertical transitions are commonly encountered in high-frequency test setups or the input and output ports of high-frequency components for signal transmissions between a coaxial cable 200 and a microstrip line 300.

In addition, the configuration of a top-mounted vertical transition shown in FIG. 1B may find applications in some designs, in which the coaxial connector 100A is placed above the signal line 330 of the microstrip line 300A. To prevent short circuits between the mounting wall 120 and the signal line 330, Four pillars 150 from the coaxial connector 100A of FIG. 1B serve to adjust the height of the mounting wall 120 above the signal line 330. Moreover, four additional mounting holes 314 in the substrate 310*a* of the microstrip line 300A allow the coaxial connector mounted on top of the substrate 310*a* by having the pillars 150 penetrate their corresponding mounting holes from the upper side of the substrate 310*a*, and then soldered onto the ground plane 350.

Due to the differences in the electromagnetic field distributions of the two transmission lines, and the discontinuity of the signal transmission path, insertion loss occurs at the transition. FIG. 2A shows the electromagnetic field distribution inside a coaxial cable 200, and FIG. 2B shows the electromagnetic field distribution of a microstrip line 300. There are significant differences in the electromagnetic field distributions of the two transmission lines, which cause severe insertion loss of the vertical transition at higher frequencies. However, the conventional designs shown in FIG. 1A or FIG. 1B only provide a vertical connection between a coaxial cable 200 and a microstrip line 300 or 300A, and do not solve the problem caused by the immediate change in the electromagnetic field distributions of the two transmission lines. Therefore, the severe insertion loss at higher frequencies cannot be effectively reduced, and the 1-dB passband of the conventional vertical transitions is confined at lower frequencies, which excludes themselves from the applications at higher-frequency bands.

In order to reduce the insertion loss and to improve the 1-dB passband as described above, one known technique enlarged the through hole 312, which makes the assembly difficult to accurately position the center conductor 130 for the vertical transitions. Additional mounting holes in the substrate 310 or 310*a* would help, but result in an increase in manufacturing cost.

Therefore, a design for wide-band vertical transitions is desired to cover higher-frequency bands, to reduce the insertion loss, to enhance the 1-dB passband, and probably to extensively replace the existing vertical transitions without additional efforts to accurately position the center conductor 130 or the coaxial connector 100 or 100A.

SUMMARY OF THE INVENTION

One object of the present invention is to provide a method for a vertical transition between a coaxial structure and a microstrip line. Compared to conventional vertical transitions, the present invention can offer lower insertion loss and a larger 1-dB passband.

Another object of the present invention is to provide a method not only to greatly increase the 1-dB passband of a vertical transition between a coaxial structure and a microstrip line by simply changing the number or the configurations of the through holes within the slot in the ground plane of the microstrip line, but also to allow the center conductor to penetrate the substrate without additional efforts to fix the center conductor.

In order to achieve one of or all of the aforementioned objects, the present invention provides a method for a vertical transition between a coaxial structure and a microstrip line, which comprises the following steps: providing a microstrip line and a coaxial structure, wherein the microstrip line comprises a substrate, a signal line and a ground plane, the substrate exhibiting an upper surface and a lower surface opposite to the upper surface, the signal line being deposited on the upper surface, the ground plane being deposited on the lower surface, wherein the coaxial structure contains a center conductor with an unwrapped end; having a portion of the ground plane removed to become a slot right below one end of the signal line for vertical connection; creating a plurality of through holes within the slot, the through holes including a transition hole and at least one second through hole, wherein the transition hole is next to the end of the signal line, the transition hole and the slot establishing a first eccentric configuration, and the second through hole and the slot establishing a second eccentric configuration; and managing the extended direction of the unwrapped end of the center conductor and the extended direction of the signal line to be perpendicular to each other, and electrically connecting the unwrapped end of the center conductor to the end of the signal line through the transition hole within the slot.

In an embodiment, the method further comprises: attaching a second substrate under the ground plane; creating a plurality of third through holes in the second substrate to correspond to the transition hole and the second through hole in the substrate on a one-to-one basis; depositing a second ground plane under the second substrate; and removing a portion of the second ground plane to create a second slot to correspond to the slot of the ground plane.

In an embodiment, a circular slot is considered, the method further comprises: dividing the area of the circular slot into a first sectorial region and a second sectorial region, wherein the first sectorial region exhibits an extended angle less than 180 degrees, and the second sectorial region exhibits an extended angle greater than 180 degrees; creating the transition hole in the first sectorial region; and hollowing out the entire second sectorial region to generate the second through hole.

In an embodiment, the edge of the second sectorial region is established by a circular-curve edge with its two ends connected to a first straight edge and a second straight edge, respectively, and the other ends of the two straight edges connected to each other, the method further comprises: modifying the corner defined by the connection of the circular-curve edge and the first straight edge into a first rounded corner; and modifying the corner defined by the connection of the circular-curve edge and the second straight edge into a second rounded corner.

In an embodiment, a circular slot is considered, and the at-least-one second through hole comprises multiple second through holes, the method further comprises: creating the multiple second through holes within the circular slot, wherein the multiple second through holes include a round-end rectangular through hole and two circular through holes; and creating the transition hole between the two circular through holes.

In an embodiment, the method further comprises: creating the second through hole as a hole with its edge comprising a circular-curve edge and three connected straight edges making three sides of a rectangle.

In an embodiment, the method further comprises: creating the second through hole as a C-figure through hole.

In an embodiment, the coaxial structure includes a mounting wall, the method further comprises: having the unwrapped end of the center conductor penetrate through the transition hole from the ground-plane side of the microstrip line; and attaching the mounting wall onto the ground plane.

In an embodiment, the method further comprises: placing a metallic ring against the inner wall of the transition hole and electrically connecting the metallic ring to the signal line; having the unwrapped end of the center conductor penetrate through the transition hole from the upper side of the microstrip line; and having the penetrating end of the center conductor soldered to the metallic ring from the ground-plane side to electrically connect the center conductor to the signal line.

In an embodiment, the coaxial structure contains a mounting wall, the method further comprises: adding four pillars at the four corners of the mounting wall to turn a flange-mount coaxial connector into a PCB-mount coaxial connector, each pillar containing a base, which is connected to the mounting wall and exhibits a thickness greater than the thickness of the signal line to prevent short circuits between the mounting wall and the signal line; creating four mounting holes in the substrate and outside the slot area with each mounting hole created for a corresponding pillar to pass through; and having each of the pillars penetrate its corresponding mounting hole from the upper side of the microstrip line, and then soldering the penetrating end of each pillar onto the ground plane.

The method of the present invention for vertical transitions establishes an eccentric configuration with respect to the slot in the ground plane of the microstrip line and the transition hole for the center conductor of the coaxial connector to pass through, and the eccentric design serves as a contributor to improve the vertical signal transmissions between the coaxial structure and the microstrip line. The eccentric configuration with respect to the transition hole for the center conductor of the coaxial connector and the slot in the ground plane of the microstrip line can improve the electromagnetic field transformation between the coaxial structure and the microstrip line at their vertical transition, and reduce the insertion loss caused by the differences in the electromagnetic field distributions. A transition hole of appropriate size adds another benefit of fixing the center conductor. By creating other through holes in the slot to relocate the resonant response caused by the slot and the nearby conductors to higher frequencies, the 1-dB passband of the vertical transition can be further increased. Therefore, compared with the conventional vertical transition, the present invention can greatly improve the 1-dB passband of the vertical transition of between the above two transmission lines, and can widely apply to high-frequency device testing and system integration.

DESCRIPTION OF THE PREFERRED EMBODIMENTS

In the following the details of a preferred embodiment accompanied by its corresponding drawings clearly explain the early statements on this invention and other technical contents, features, and functions. In this regard, the direction-related terms, such as "top," "bottom," "left," "right," "front," "back," etc., are used with reference to the orientations of the objects in the Figure(s) being considered. The components of the present invention can be positioned in a number of different orientations. As such, the direction-related terms are used for the purposes of illustration and by no means as restrictions to the present invention. On the other hand, the sizes of the objects in the schematic drawings may be overstated for the purpose of clarity. It is to be understood that other likely-employed embodiments or possible changes made in the structure of the present invention should not depart from the scope of the present invention. Also, it is to be understood that the phraseology and the terminology used herein are for the purpose of description and should not be regarded as limits to the present invention. The use of "including," "comprising," or "having" and variations thereof herein is meant to cover the items listed thereafter and equivalents thereof as well as additional items. Unless otherwise stated, the terms "connected," "coupled," and "mounted" and variations thereof herein are used in a broad sense and cover direct and indirect connections, couplings, and mountings. Similarly, the terms "facing," "faces" and variations thereof herein are used in a broad sense and cover direct and indirect facing, and the term "adjacent to" and variations thereof herein is used in a broad sense and cover directly and indirectly "adjacent to". Therefore, the description of "A" component facing "B" component herein may include the situations that "A" component facing "B" component directly or one or more additional components between "A" component and "B" component. Also, the description of "A" component "adjacent to" "B" component herein may include the situations that "A" component is directly "adjacent to" "B" component or one or more additional components between "A" component and "B" component. Accordingly, the drawings and the descriptions will be regarded as illustrative in nature, but not restrictive.

Figure 3:
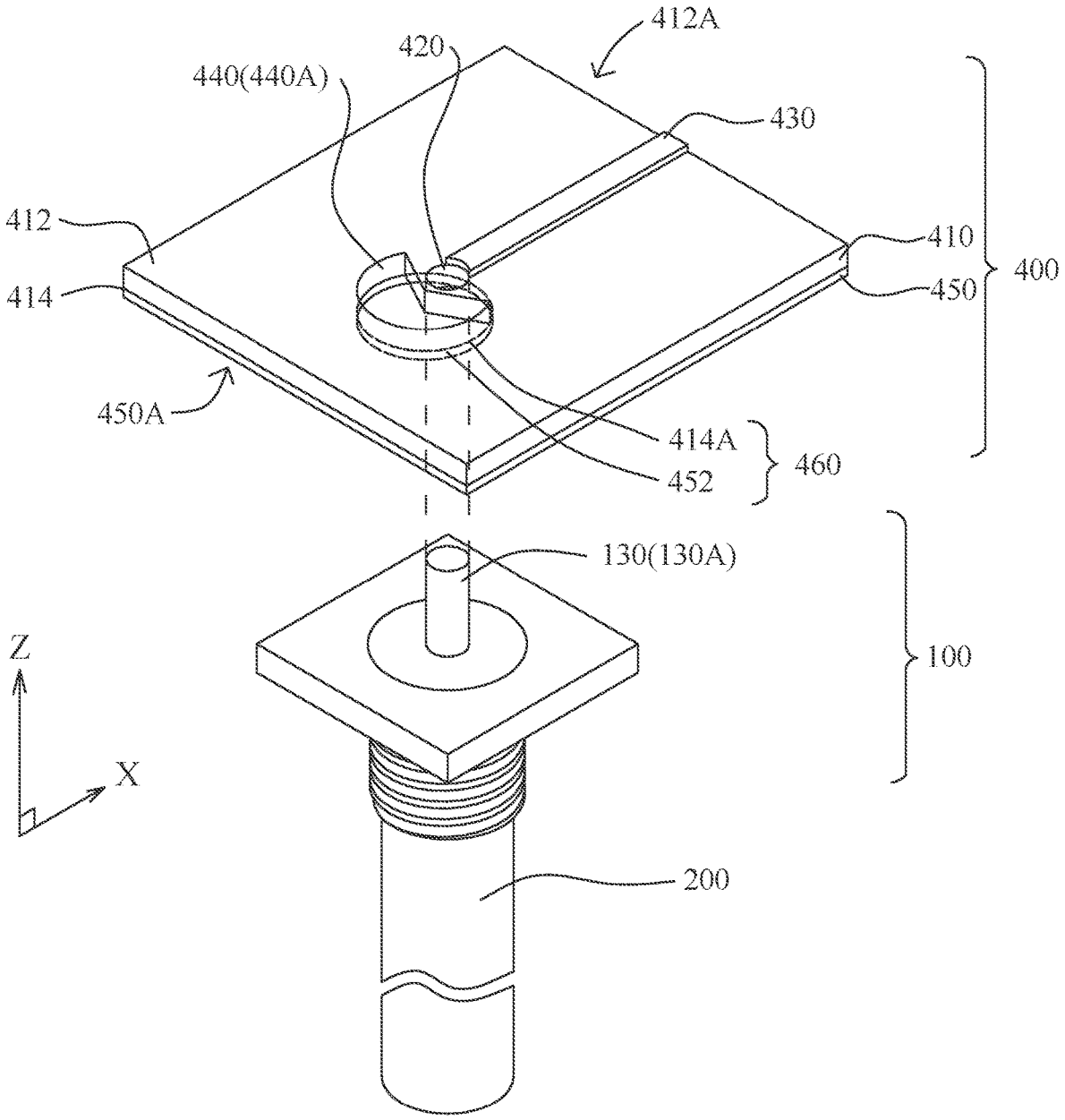
FIG. 3 is the schematic view of the first embodiment for a rear-mounted vertical transition according to the present invention.

FIG. 3 shows a method for the vertical transition between a coaxial structure and a microstrip line according to a first embodiment of the present invention. In the first embodiment a conventional flange-mount SMA (Sub-Miniature version A) coaxial connector 100 is placed below a novel microstrip line 400, that is, located underneath the side of the ground plane 450, hereinafter referred to as "rear-mounted vertical transition". The configuration of the coaxial connector 100 is the same as the one described in FIG. 1A. The microstrip line 400 includes a substrate 410, a signal line 430, and a ground plane 450. The substrate 410 exhibits an upper surface 412 and a lower surface 414. The signal line 430 is deposited on the upper surface 412 of the substrate 410, and the side of the microstrip line 400 where the signal line 430 appears is referred to as an "upper side 412A". The signal line 430 may present itself in different circuit layouts depending on actual needs. The ground plane 450 is deposited on the lower surface 414, and the side of the microstrip line 400 where the ground plane 450 appears is referred to as a "ground-plane side 450A".

In the method for the vertical transition shown in FIG. 3, the following process is applied to the ground plane 450 and the substrate 410 of the microstrip line 400:

A portion 452 of the ground plane 450 below one end of the signal line 430 is removed. The removed portion 452 of the ground plane 450 allows a portion of the lower surface 414 of the substrate 410 exposed, which is referred to as an exposed bottom surface 414A. The exposed bottom surface 414A and the removed portion 452 of the ground plane 450 establish a slot 460. Next, a plurality of through holes 420, 440 are created within the slot 460 such that the through holes 420, 440 extend from the upper surface 412 of the substrate 410 to the lower surface 414. The through holes 420, 440 include an transition hole 420 and at least one second through hole 440. The transition hole 420 is created next to the end of the signal line 430 to position and to firmly fix the center conductor 130 of the coaxial connector 100 within the slot 460 and to allow the center conductor 130 to penetrate the substrate 410.

It should be noted that in the present invention the transition hole 420 and the slot 460 establish a first eccentric configuration, which may improve the 1-dB passband of the vertical transition. The second through hole 440 is created to relocate a resonant response caused by the introduction of the slot 460 and establishes a second eccentric configuration with the slot 460. In other embodiments, different numbers and configurations of the second through holes 440 may be used.

The resonant response is caused by the parasitic parameters of the slot 460. The "parasitic parameters" refer to parasitic inductances induced by the signal line 430 within the slot 460 and the center conductor 130 penetrating the slot 460, and parasitic capacitances contributed by the center conductor 130, the signal line 430, the substrate 410 in the area of the slot 460, and the ground plane 450 nearby. The combination of both parasitic inductances and parasitic capacitances establishes a resonant circuit that generates a resonant response at its resonant frequency. This resonant response may lessen the improvement contributed by the first eccentric configuration on the 1-dB passband of the vertical transition. Accordingly, the present invention adds one or more second through holes 440 in the slot 460 to relocate the resonant response, moving the resonant frequency toward a higher frequency, thereby increasing the 1-dB passband of the vertical transition.

When the vertical transition is assembled, the extended Z-direction of the center conductor 130 and the extended X-direction of the signal line 430 are oriented perpendicular to each other, the unwrapped end 130A of the center conductor 130 passes through the transition hole 420 from the ground-plane side 450A of the microstrip line 400, and then the unwrapped end 130A of the center conductor 130 is electrically connected to one end of the signal line 430 after the unwrapped end of the center conductor 130 passes through the transition hole 420 of the substrate 410.

Figure 3A:
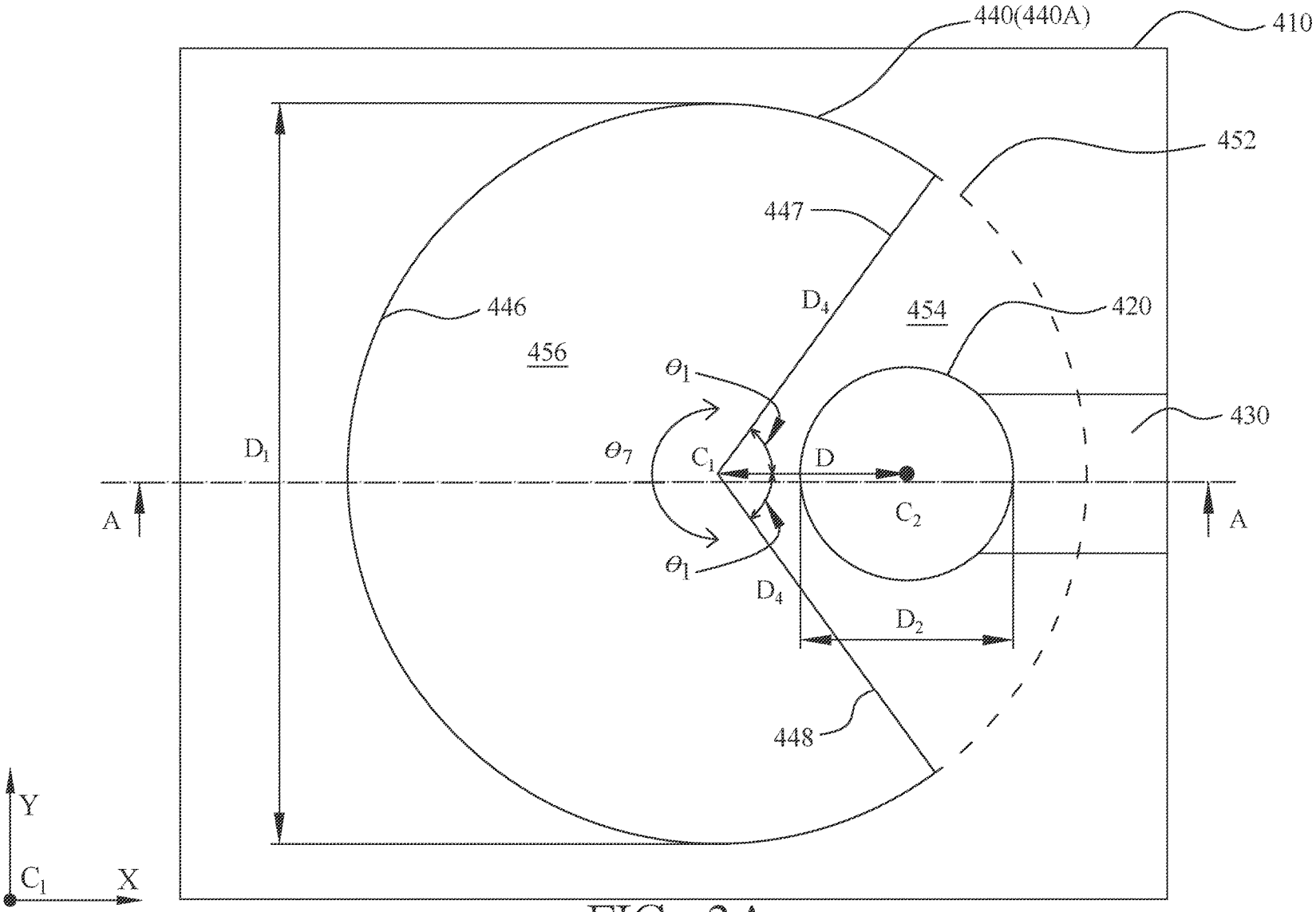
FIG. 3A is the top view of the slot area in the first embodiment of the present invention.

FIG. 3A is the top view of the microstrip line 400 of FIG. 3. The removed portion 452 of the ground plane 450 is circular, and the circular slot 460 is established by the removed portion 452 and the ground plane 450 and the exposed bottom surface 414A of the substrate 410 therewith. The circular removed portion 452 is larger in size than the center conductor 130 of the coaxial connector 100, and the center conductor 130 passes through the transition hole 420 to create an eccentric circular configuration with respect to the circular removed portion 452, and the slot 460 as well. As shown in FIG. 3A, the center $C_1$ of the removed portion 452 and the center $C_2$ of the transition hole 420 are not at the same location. Under this circumstance, the electromagnetic field distribution of the coaxial structure may be gradually transformed into the electromagnetic field distribution of the microstrip line 400 due to the eccentric arrangement of the slot 460. Therefore, the eccentric arrangement benefits the electromagnetic field transformation between the two transmission lines, reducing the insertion loss and return loss of the vertical transition at higher frequencies, thereby improving the transmission characteristics of the vertical transition at higher frequencies as well.

It should be also noted that the signal line 430 of the microstrip line 400 extends into the area of the circular slot 460. After assembly, the joint between the signal line 430 and the center conductor 130 of the coaxial connector 100 is produced at the unwrapped end 130A of the center conductor 130, and typically, the size of the joint will cover the entire circular cross section of the unwrapped end 130A of the center conductor 130. Therefore, the joint and the circular slot 460 also establish an eccentric circular configuration.

Figure 3B:
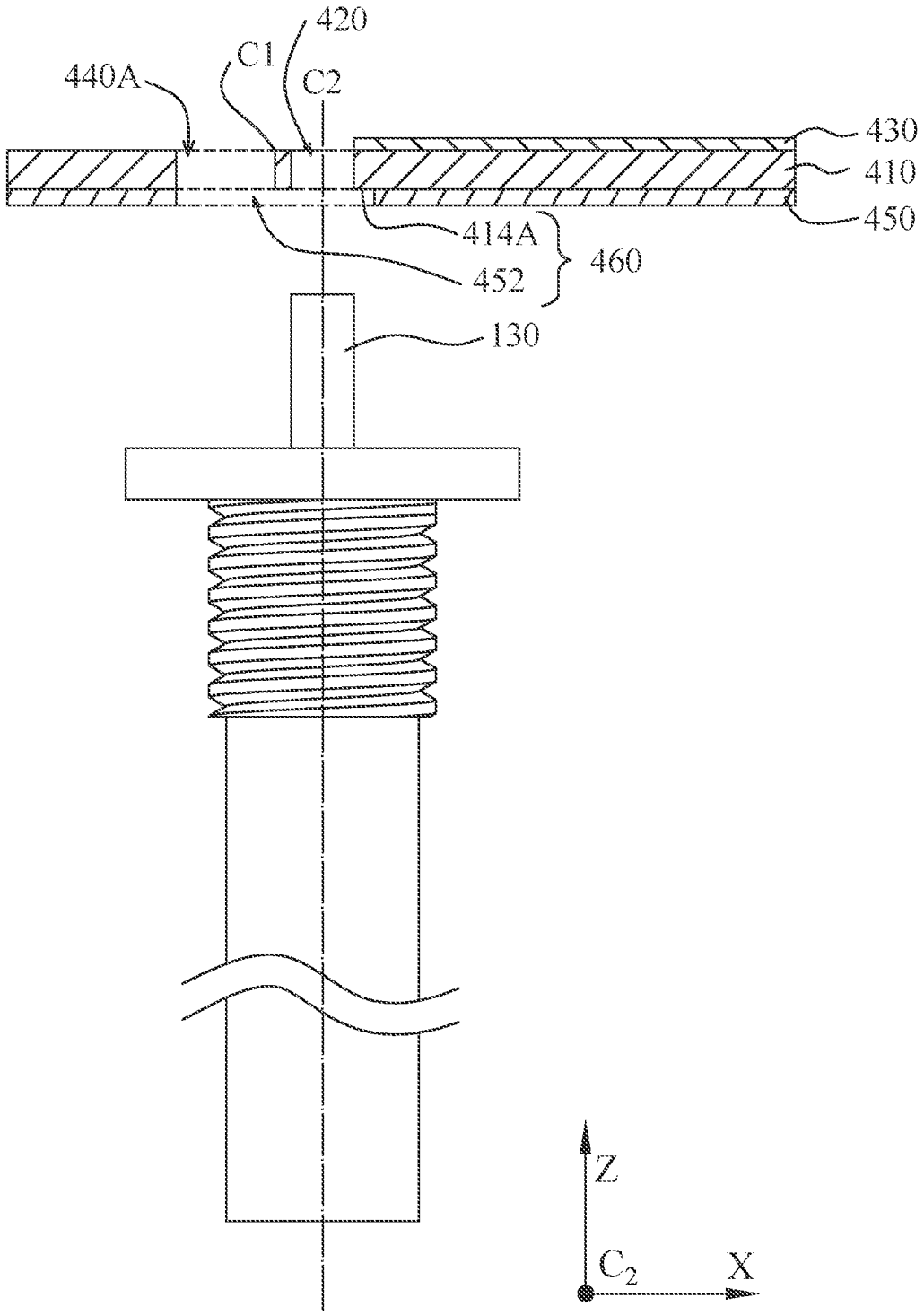
FIG. 3B is the transverse view of the slot area in the first embodiment of the present invention.

In the present embodiment, the exposed bottom surface 414A in the circular slot 460 is divided into a first sectorial region 454 and a second sectorial region 456. The first sectorial region 454 exhibits an extended angle of less than 180 degrees, and the second sectorial region 456 exhibits an extended angle greater than 180 degrees. The extended angle of the first sectorial region 454 in FIG. 3A is twice the angle of $\theta_1$. The extended angle of the second sectorial region 456 in FIG. 3A is the angle of $\theta_7$. The transition hole 420 is created in the first sectorial region 454. The second through hole 440 is a sectorial through hole 440A created by hollowing out the entire second sectorial region 456 of the substrate 410. Thus, a plurality of through holes 420 and 440A are created in the circular slot 460. The relative position of the sectorial through hole 440A and the center conductor 130 of the coaxial connector 100 on the X-Y horizontal plane may clearly be seen from FIG. 3A. The cross-sectional view through A-A in FIG. 3A may clearly be observed in FIG. 3B, showing the relative positions of the sectorial through hole 440A, the transition hole 420, and the circular slot 460 on the X-Z vertical plane.

In FIG. 3A, the substrate 410 is characterized by a dielectric constant of 6.15, a thickness of 32 mils, and a size of 30 mm×40 mm. $C_1$ is defined as the center of the removed portion 452. The diameter $D_1$ of the removed portion 452 is 150 mils. The location of the center $C_2$ of the transition hole 420 is placed to the right side of the location of the center $C_1$ by a distance D of 35 mil. The diameter $D_2$ of the transition hole 420 is 50 mils. The circular-curve edge 446 of the sectorial through hole 440A follows a portion of the edge of the circular removed portion 452. The length $D_4$ of either one of the two straight edges 447, 448 of the sectorial through hole 440A is 75 mil, and the angle $\theta_1$ between either one of the two straight edges 447, 448 and the +X-axis is 60 degrees.

The rear-mounted vertical transition shown in FIG. 3 exhibits the following important technical features: (1) the transition hole 420 and the second through hole 440 coexist within the circular slot 460, and each establishes its own eccentric configuration with respect to the removed portion 452, and the slot 460 as well; (2) the parasitic resonance response is relocated due to the introduction of the second through hole 440; (3) the center conductor 130 is firmly fixed at the location of the transition hole 420, and then the mounting wall 120 of the coaxial connector 100 is soldered onto the ground plane 450. With the above technical features, the present invention may simultaneously offer various advantages such as reducing the insertion loss at higher frequencies, increasing the 1-dB bandwidth, relocating the parasitic resonance frequency, and providing an easy way to position and to firmly fix the center conductor 130 with a simple through hole.

Figure 4:
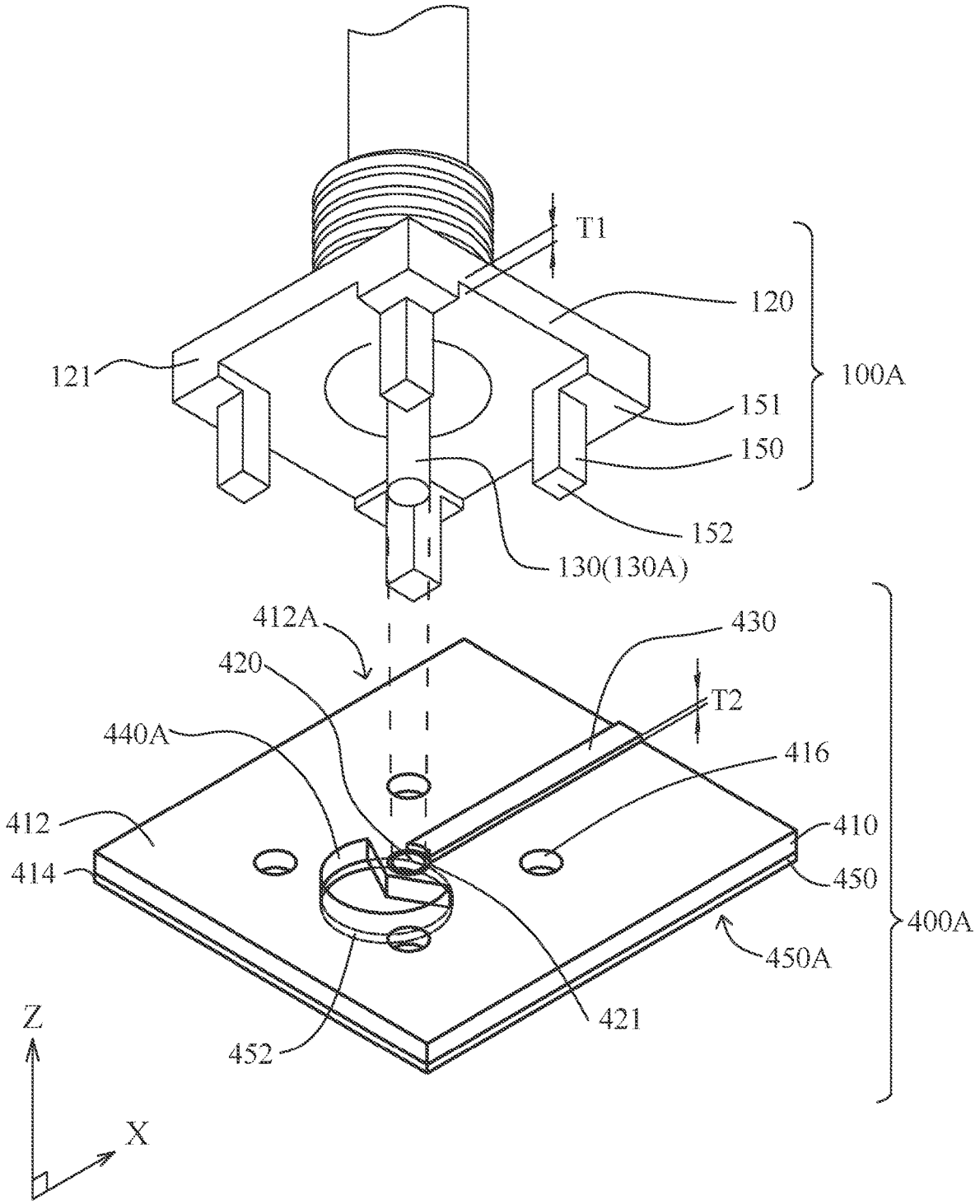
FIG. 4 is the schematic view of the second embodiment for a top-mounted vertical transition according to the present invention.

FIG. 4 is a second embodiment of the present invention in which the coaxial connector 100A is placed above the microstrip line 400A. The unwrapped end 130A of the center conductor 130 passes through the transition hole 420 from the upper side 412A of the microstrip line 400, and is soldered to a metallic ring 421 from the ground-plane side 450A of the microstrip line 400 to electrically connect the center conductor 130 to the signal line 430. In FIG. 4, the mounting wall 120 includes four corners 121. To turn a flange-mount coaxial connector 100 into a PCB-mount coaxial connector 100A, four pillars 150 are attached to the mounting wall 120 of the coaxial connector 100A with one pillar 150 connected to each corner 121 of the mounting wall 120 through a base 151 at the end of the pillar 150. The thickness T1 of the base 151 is required to be greater than the thickness T2 of the signal line 430. The substrate 410 of the microstrip line 400A includes a plurality of mounting holes 416 outside the removed portion 452 of the ground plane 450. These mounting holes 416 are created for the penetration of the pillars 150 through the substrate 410 and the ground plane 450, which is another technical feature besides the ones shown in FIG. 3. Each mounting hole 416 is created for its corresponding pillar 150 under the mounting wall 120 to pass through the substrate 410 and the ground plane 450. The penetrating end 152 of each pillar 150 is soldered onto the ground plane 450 afterwards to fix the coaxial connector 100A above the microstrip line 400A. It should be also noted that the base 151 of the pillar 150 of the coaxial connector 100A is introduced to prevent short circuits between the mounting wall 120 and the signal line 430 after final assembly.

Figure 4A:
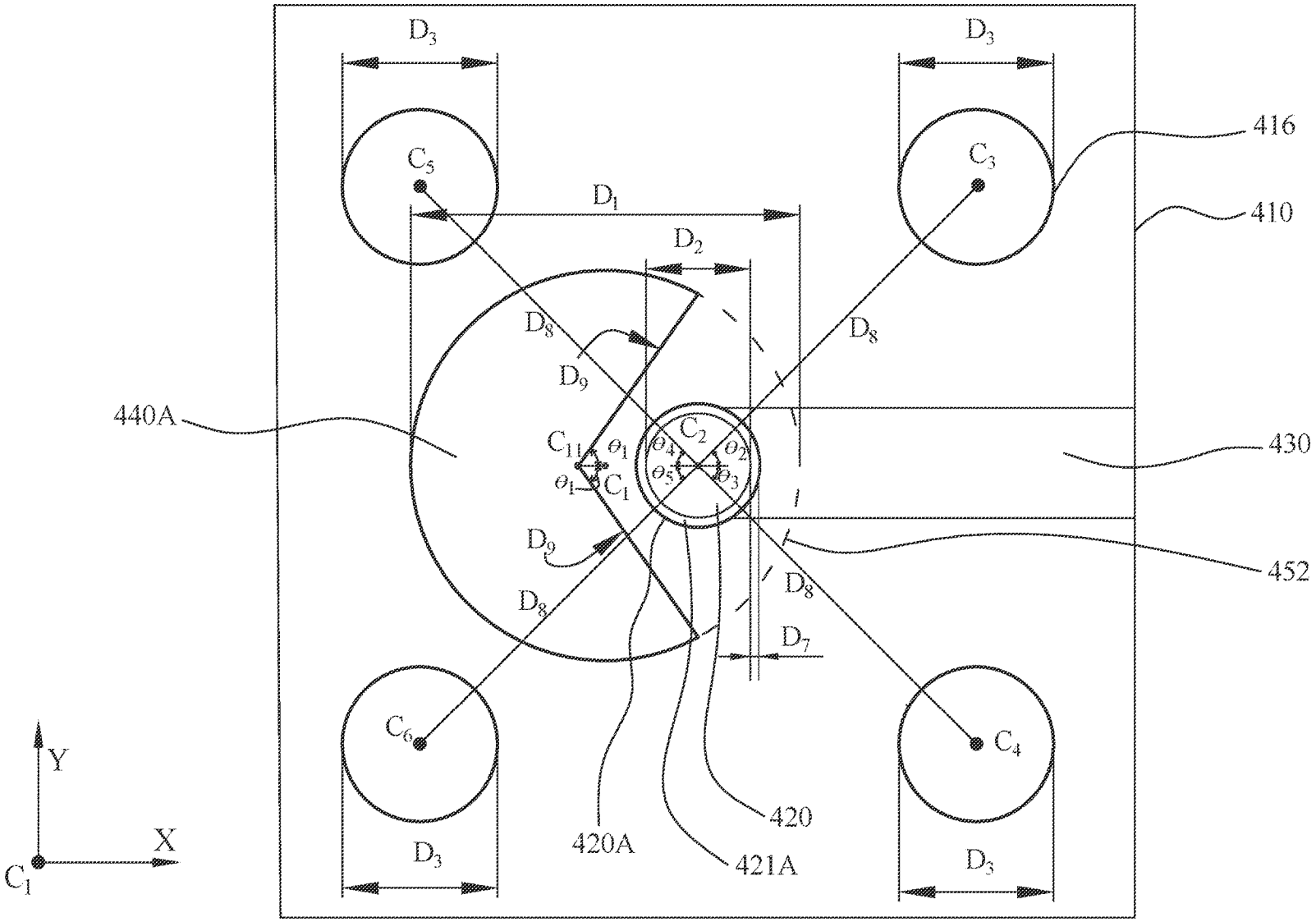
FIG. 4A is the top view of the slot area in the second embodiment of the present invention.

As shown in FIG. 4A, the substrate 410 is characterized by a dielectric constant of 6.15, a thickness of 32 mils, and a size of 30 mm×40 mm. $C_1$ is defined as the center of the removed portion 452, and the diameter $D_1$ of the removed portion 452 is 164 mils. The center $C_2$ of the transition hole 420 is placed to the right side of the location of the center $C_1$ by a distance of 20 mils, and the diameter $D_2$ is equal to 50 mils. The metallic ring 421, for example a copper ring 421A, is placed against the inner wall 420A of the transition hole 420 and is electrically connected to the signal line 430. The thickness $D_7$ of the copper ring 421A is 1.5 mil. The circular-curve edge of the sectorial through hole 440A follows a part of the edge of the circular removed portion 452. The length $D_9$ of either of the two straight edges of the sectorial through hole 440A is 87 mil, and the angle $\theta_1$ between the +X-axis and either of the two straight edges is 70 degrees. The intersection $C_{11}$ of the two straight edges is located to the left side of the center $C_1$, which is different from the arrangement in the embodiment from FIG. 3A. The diameter $D_3$ of any of the mounting holes 416 is 67 mils. The distance $D_8$ between any of the centers $C_3$, $C_4$, $C_5$, and $C_6$ of the mounting holes 416 and the center $C_2$ of the transition hole 420 is 149 mils. The angle $\theta_2$ between the +X-axis and the line connecting $C_2$ and $C_3$ is 42 degrees, so is the angle $\theta_3$ between the +X-axis and the line connecting $C_2$ and $C_4$. And the angle $\theta_4$ between the −X-axis and the line connecting $C_2$ and $C_5$ is 42 degrees, so is the angle $\theta_5$ between the −X-axis and the line connecting $C_2$ and $C_6$.

The metallic ring 421 described above is also referred to as an "conductive through hole" to provide electrical connection between the center conductor 130 and the signal line 430. Due to the top-mounted design of the vertical transition, the penetrating end of the center conductor 130 and the end of the signal line 430 of the microstrip line 400A for vertical connection are all placed below the mounting wall 120 of the coaxial connector 100A, thus, it is difficult to provide a direct connection for both ends on the upper surface 412 of the substrate 410, but an indirect connection for both ends can be accomplished from the ground-plane side 450A of the microstrip line 400A through the conductive through hole. Such a problem does not exist for the rear-mounted design of the vertical transition, and the connection between the signal line 430 and the center conductor 130 may be directly accomplished on the upper surface 412 of the substrate 410, so that no "conductive through hole" is required for the rear-mounted design of the vertical transition.

Figure 5B:
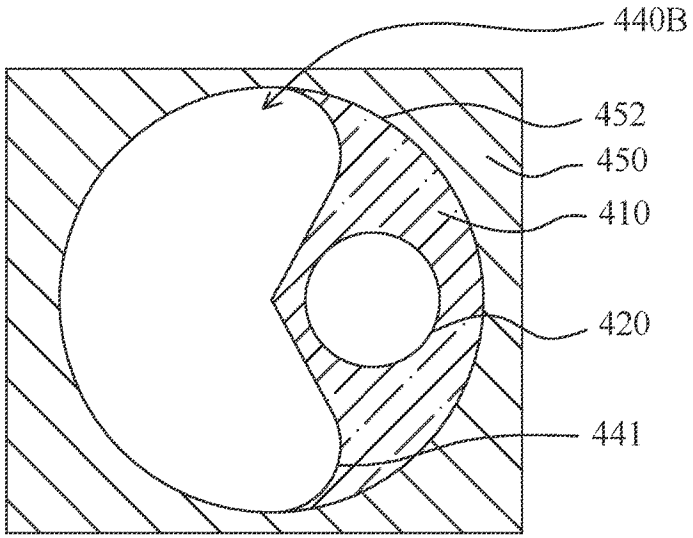
FIG. 5B is the rear view of the slot area from FIG. 5A.
Figure 5A:
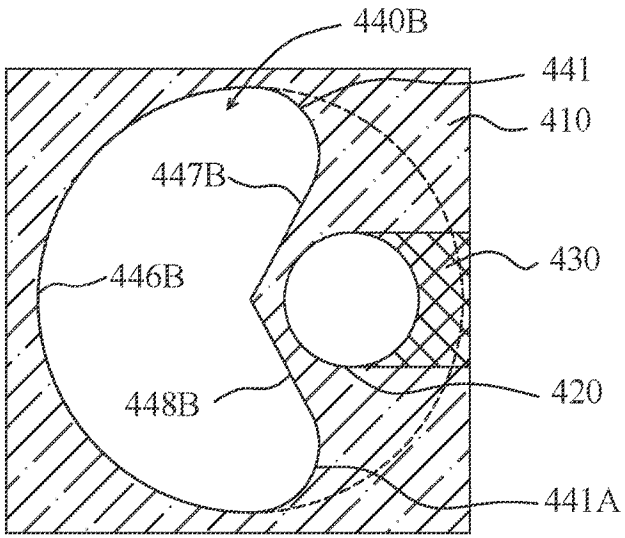
FIG. 5A is the top view of the slot area in one embodiment of the present invention, which is the first variation of FIG. 3A.

FIG. 5A is a first variation of the sectorial through hole 440A from FIG. 3A, and FIG. 5B is the rear view thereof. The corner produced by the connection of the circular-curve edge 446B of the sectorial through hole 440A and either one of the two straight edges 447B, 448B is modified into a rounded corner to create another type of sectorial through hole 440B, and the horizontal view of the sectorial through hole 440B includes two rounded corners 441 and 441A. Such variation help to simplify the fabrication process of the second through hole 440.

Figure 6B:
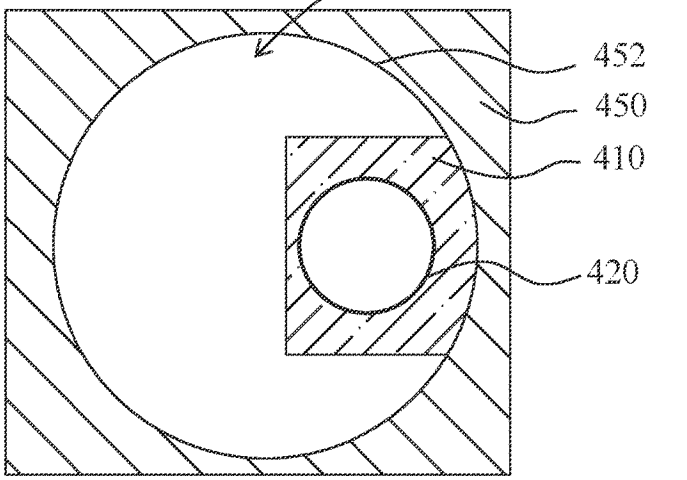
FIG. 6B is the rear view of the slot area from FIG. 6A.
Figure 6A:
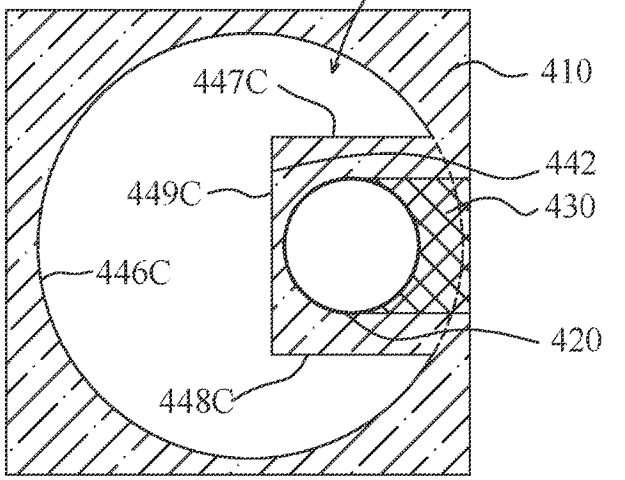
FIG. 6A is the top view of the slot area in one embodiment of the present invention, which is the second variation of FIG. 3A.

FIG. 6A is a second variation of the sectorial through hole 440A, and FIG. 6B is the rear view thereof. The two straight edges 447B, 448B of the sectorial through hole 440A are modified into three connected straight edges 447C, 448C and 449C making three sides of a rectangle 442. The connection of the three connected straight edges 447C, 448C, 449C and the circular-curve edge 446C creates another type of through hole 440C. The transition hole 420 is located in the area of the substrate 410 confined by the three connected straight edges 447C, 448C, 449C and a relatively small part of the edge of the removed portion 452. Such variation is to maximize the area of the second through hole 440 to help maximize the 1-dB passband of the vertical transition.

Figure 7B:
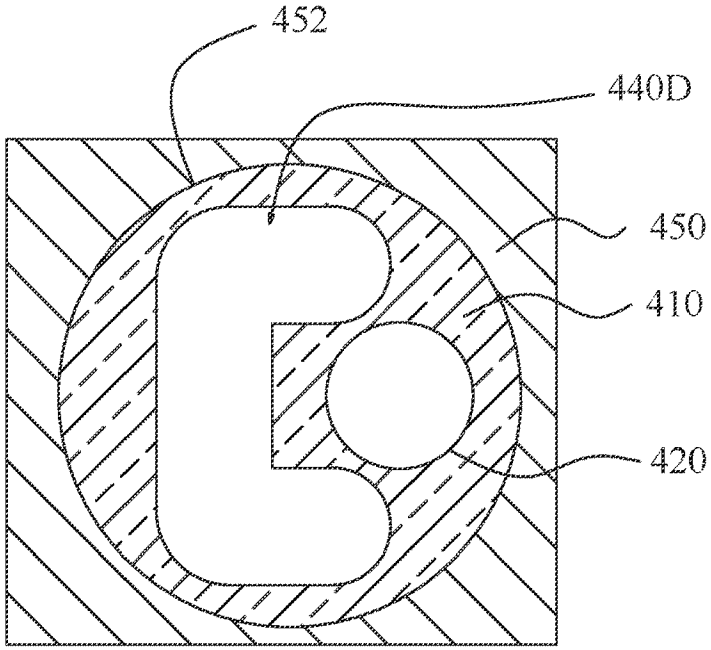
FIG. 7B is the rear view of the slot area from FIG. 7A.
Figure 7A:
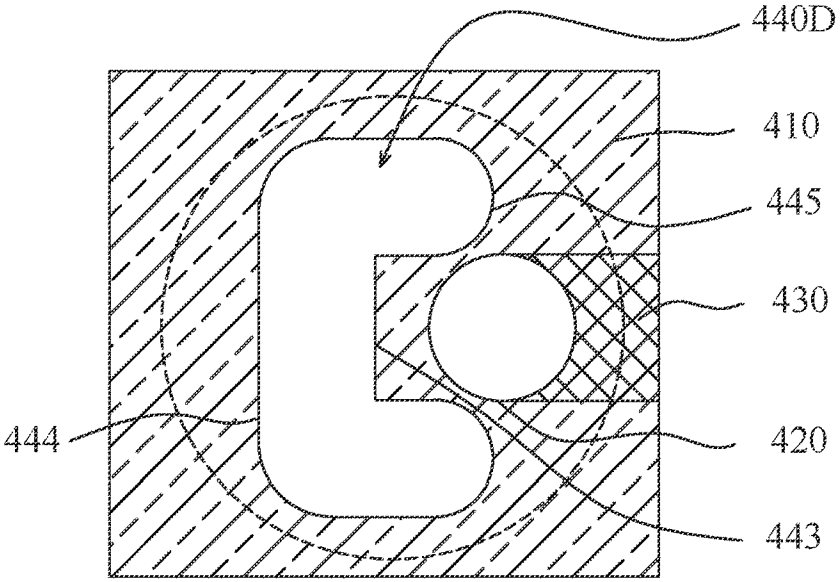
FIG. 7A is the top view of the slot area in one embodiment of the present invention, which is the third variation of FIG. 3A.

FIG. 7A is a third variation of the sectorial through hole 440A, and FIG. 7B is the rear view thereof. The sectorial through hole 440A is modified into a C-figure through hole 440D comprising a C-figure inner edge 433 and a C-figure outer edge 444. The C-figure inner edge 443 is connected to the C-figure outer edge 444 by connecting each of the two paired ends from the C-figure inner edge 443 and the C-figure outer edge 444, respectively, through a circular-curve edge 445 to complete the configuration of the C-figure through hole 440D, as shown in FIG. 7A. Such variation may simultaneously take into account the cost of the fabrication process for the second through hole 440 and the increase of the 1-dB passband of the vertical transition.

Figure 7C:
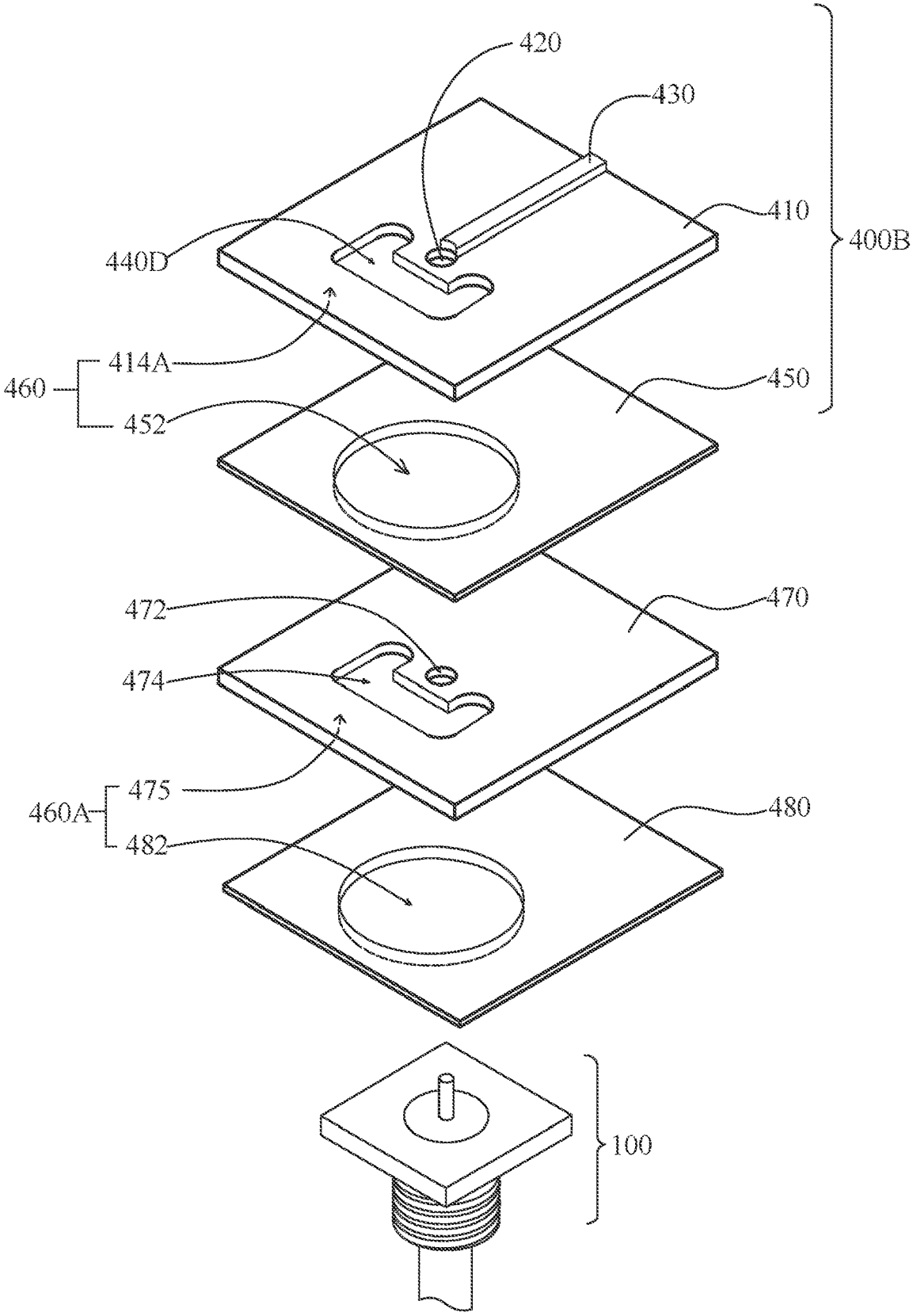
FIG. 7C is an embodiment of a C-figure through hole for a multilayer vertical transition.

FIG. 7C is an embodiment of the C-figure through hole 440D applied to a multilayer circuit board. The microstrip line 400B includes a signal line 430, and a ground plane 450 and a dielectric substrate 410. The process applied to the substrate 410 and the ground plane 450 is the same as the one applied in FIGS. 7A and 7B. In the present embodiment, a second substrate 470 is attached below the ground plane 450, and a plurality of through holes 472 and 474 are created in the second substrate 470, which are duplicates of the transition hole 420 and the C-figure through hole 440D in the substrate 410. A second ground plane 480 is further introduced under the second substrate 470. More specifically, the second ground plane 480 is deposited to the second substrate 470 from its lower side. A portion of the second ground plane 480 is removed to create a second removed portion 482 corresponding to the removed portion 452 of the ground plane 450. The bottom surface 475 of the second substrate 470 and the second removed portion 482 establish a second slot 460A. Finally, the coaxial connector 100 is placed below the second ground plane 480 to establish a multilayer vertical transition.

Figure 8:
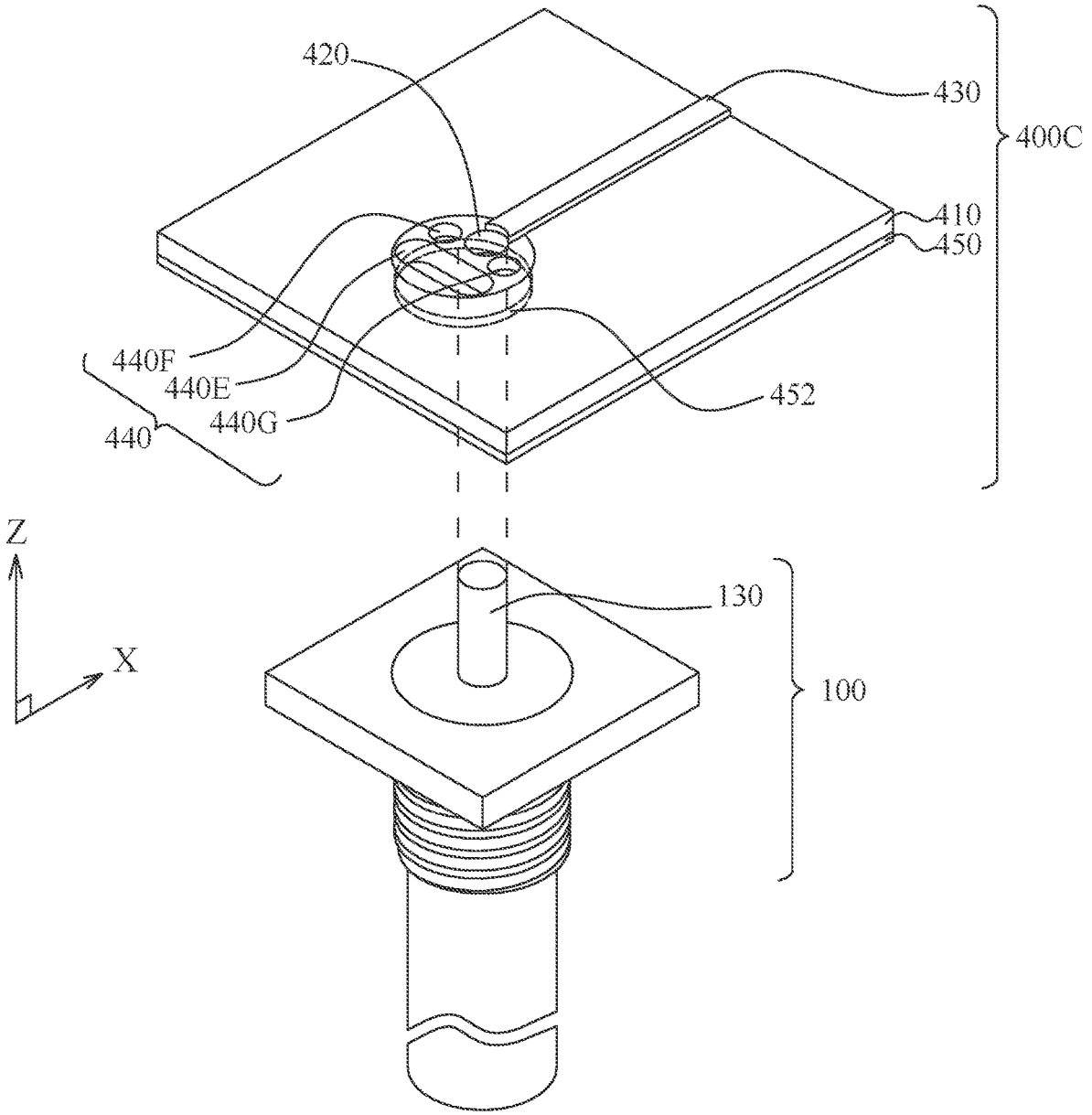
FIG. 8 is the schematic view of the third embodiment for a rear-mounted vertical transition according to the present invention.
Figure 8B:
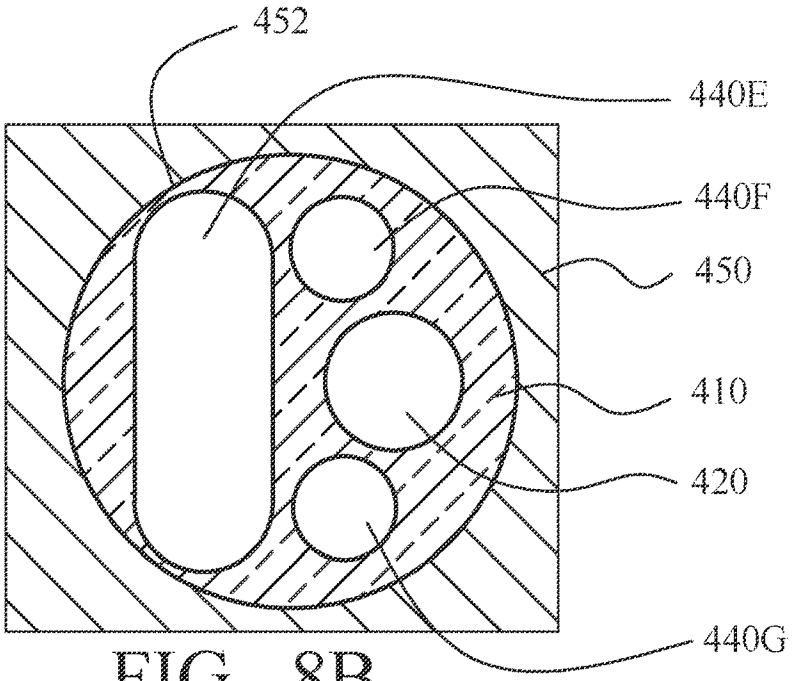
FIG. 8A and FIG. 8B are the top and rear views, respectively, of the slot area in the third embodiment of the present invention.
Figure 8A:
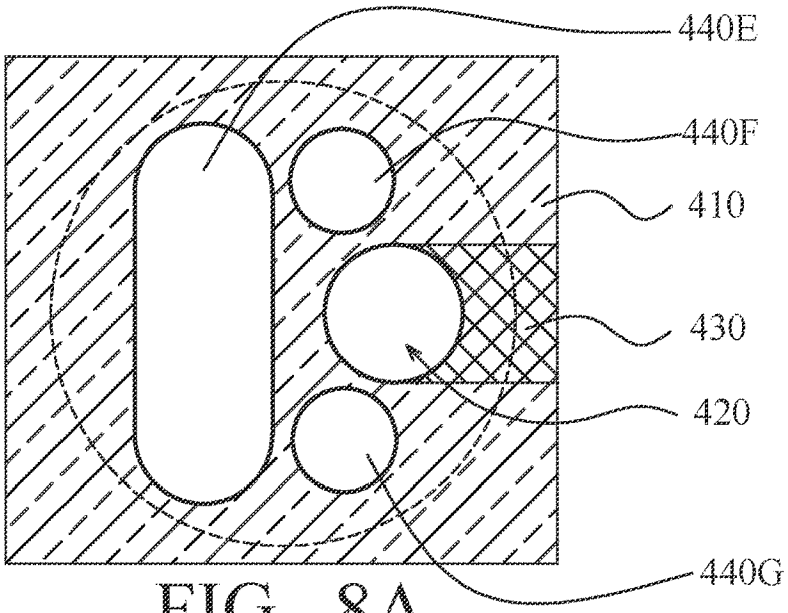

FIG. 8 shows a method for a rear-mounted vertical transition according to a third embodiment. The second through hole 440 of the microstrip line 400C includes a round-end rectangular through hole 440E and two circular through holes 440F, 440G to relocate the resonance response generated by the parasitic parameters, which are induced due to the introduction of the circular slot 460. The transition hole 420 is located between the two circular through holes 440F, 440G. The present embodiment replaces the sectorial through hole 440A from FIG. 3 with a round-end rectangular through hole 440E and two circular through holes 440F, 440G within a circular slot 460. Compared to the sectorial through hole 440A from FIG. 3, the through holes 440E, 440F, and 440G of the present embodiment are relatively simple in terms of fabrication, so that the fabrication process of the second through hole 440 may be simplified. Similar to FIG. 3, in the substrate 410 of the present embodiment, a plurality of through holes 420, 440 including the transition hole 420 are created within the circular slot 460, and each of these through holes 420, 440 establishes its own eccentric configuration with the circular slot 460. FIG. 8A is the top view of the substrate 410 of the third embodiment; and FIG. 8B is the rear view from the ground plane side. The relative positions of the removed portion 452, the round-end rectangular through hole 440E, and the circular through holes 440F, 440G and the transition hole 420 may clearly be seen from FIGS. 8A and 8B.

Figure 8C:
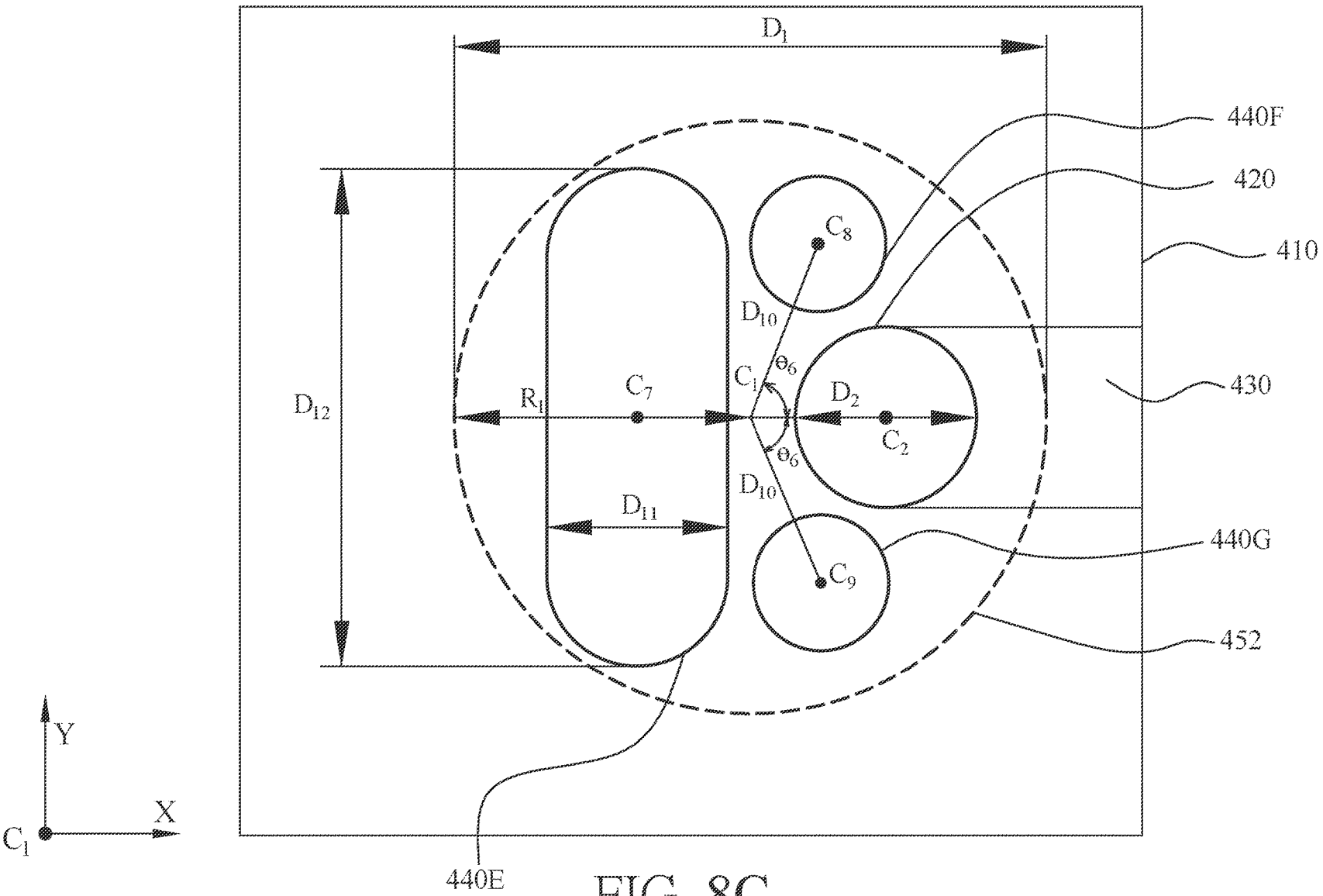
FIG. 8C is the detailed rear view of the slot area in the third embodiment of the present invention.

In the embodiment of FIG. 8C, the substrate 410 is characterized by a dielectric constant of 6.15, a thickness of 32 mils, and a size of 30 mm×40 mm. $C_1$ is defined as the center of the removed portion 452, and the diameter $D_1$ of the removed portion 452 is 170 mils. The location of the center $C_7$ of the round-end rectangular through hole 440E is the position where the center $C_1$ is shifted to the left by 23 mils. The round-end rectangular through hole 440E is characterized by a length $D_{12}$ of 173 mils and a width $D_{11}$ of 75 mils. The location of the center $C_2$ of the transition hole 420 is the position where the center $C_1$ is shifted to the right by 50 mils, and the diameter $D_2$ of the transition hole 420 is 50 mils. $C_8$ is the center of the circular through hole 440F, the direct distance $D_{10}$ between the centers $C_1$ to $C_8$ is 65 mil, and the angle $\theta_6$ between the +X-axis and the straight line connecting the centers $C_1$ and $C_8$ is 52 degrees. $C_9$ is the center of the circular through hole 440G, the direct distance $D_{10}$ between the centers $C_1$ and $C_9$ is 65 mil, and the angle $\theta_6$ between the +X-axis and the straight line connecting the centers $C_1$ and $C_9$ is 52 degrees.

Figure 9:
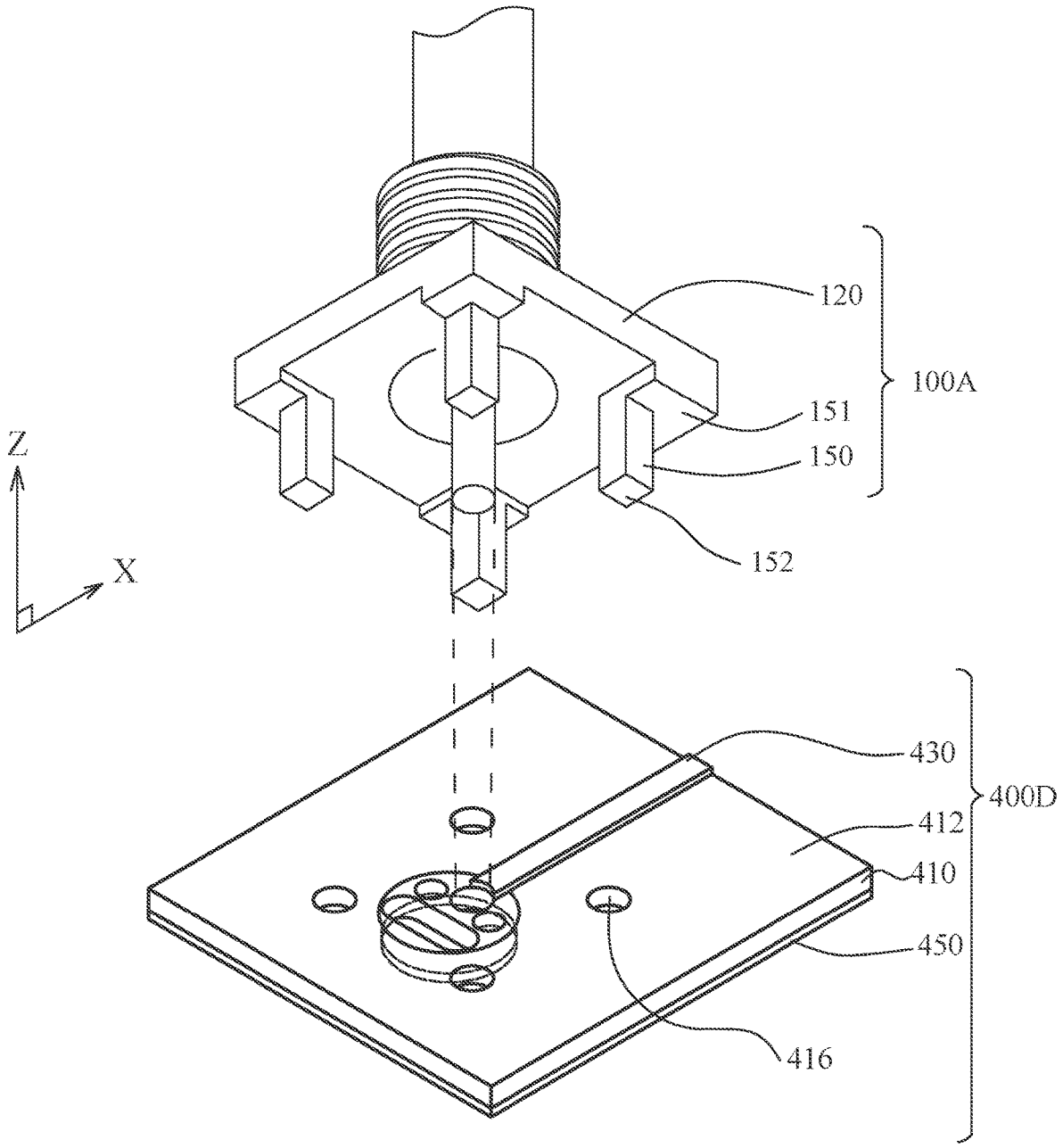
FIG. 9 is a schematic view of the fourth embodiment for a top-mounted vertical transition according to the present invention.

FIG. 9 shows a method for a top-mounted vertical transition according to a fourth embodiment of the present invention. The substrate 410 of the microstrip line 400D includes four mounting holes 416 outside the removed portion 452 of the ground plane 450, in addition to the technical features shown in FIG. 8. Each of these mounting holes 416 is created for its corresponding pillar 150 under the mounting wall 120 to pass through the substrate 410 and the ground plane 450. And the penetrating end 152 of each pillar 150 is soldered onto the ground plane 450, thereby fixing the coaxial connector 100A above the microstrip line 400D. The base 151 of each pillar 150 is designed to prevent short circuits between the mounting wall 120 and the signal line 430 after final assembly.

Figure 9A:
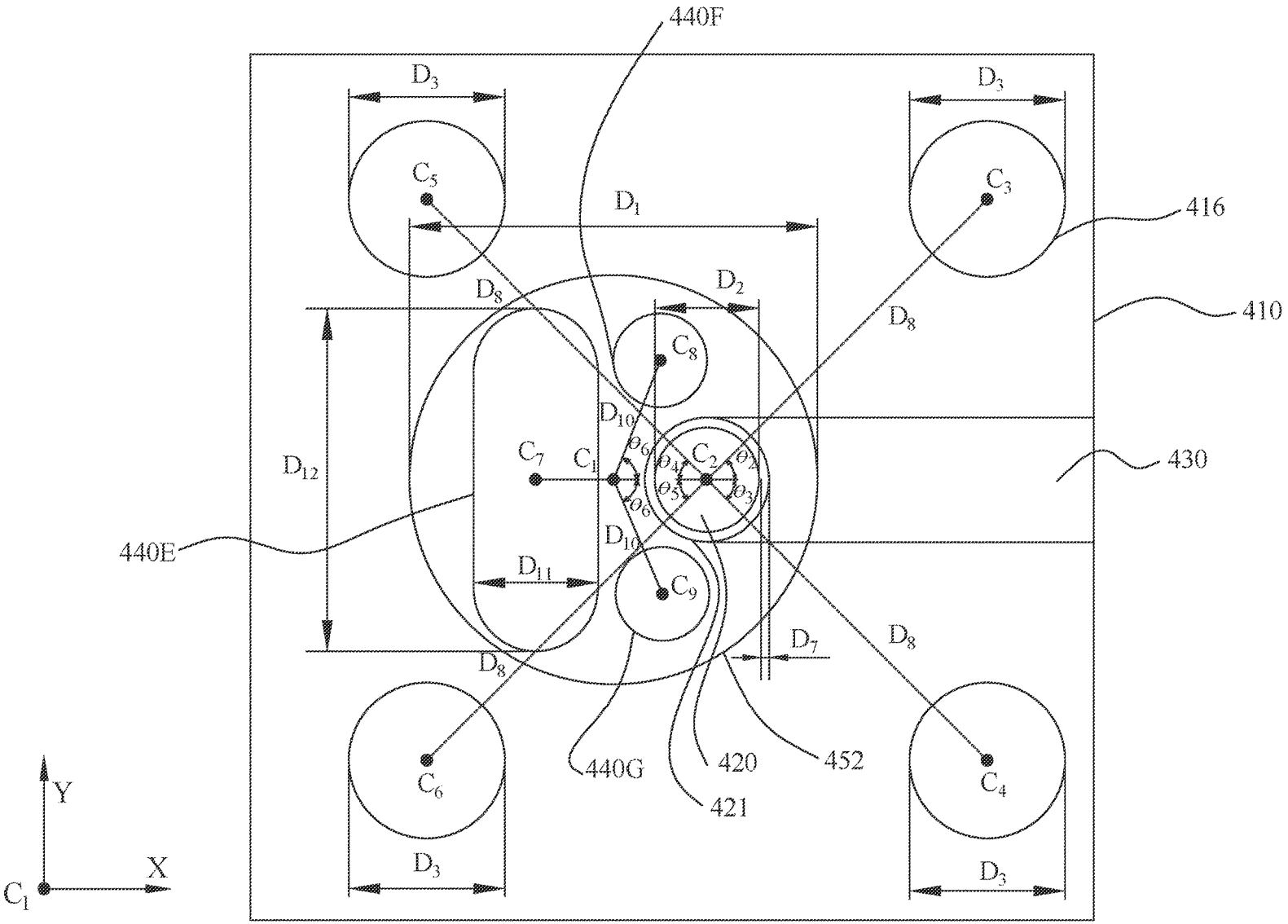
FIG. 9A is the top view of the slot area in the fourth embodiment of the present invention.

As shown in FIG. 9A, the substrate 410 is characterized by a dielectric constant of 6.15, a thickness of 32 mils, and a size of 30 mm×40 mm. $C_1$ is defined as the center of the removed portion 452, the diameter $D_1$ of the removed portion 452 is 164 mil, and the location of the center $C_7$ of the round-end rectangular through hole 440E is the position where the center $C_1$ is shifted to the left by 43 mils; the round-end rectangular through hole 440E is characterized by a length $D_{12}$ of 124 mils and a width $D_{11}$ of 53 mils. The location of the center $C_2$ of the transition hole 420 is the position where the center $C_1$ is shifted to the right by 20 mils, and the diameter $D_2$ of the transition hole 420 is 50 mils. The thickness $D_7$ of the metallic ring 421 is 1.5 mil. $C_8$ is the center of the circular through hole 440F, the direct distance $D_{10}$ between the centers $C_1$ and $C_8$ is 58 mil, and the angle $\theta_6$ between the +X-axis and the straight line connecting the centers $C_1$ and $C_8$ is 80.5 degrees. $C_9$ is the center of another circular through hole 440G, the direct distance $D_{10}$ between the centers $C_1$ and $C_9$ is 58 mil, and the angle $\theta_6$ between the +X-axis and the straight line connecting the centers $C_1$ and $C_9$ is 80.5 degrees. The four mounting holes 416 are characterized by a diameter $D_3$ of 7 mil, and their centers are $C_3$, $C_4$, $C_5$, and $C_6$, respectively. Taking the center $C_2$ of the transition hole 420 as a reference point, the direct distance $D_8$ between the center $C_2$ and any one of the centers $C_3$, $C_4$, $C_5$, and $C_6$ is 149 mil. The angle $\theta_2$ between the +X-axis and the direct line connecting the centers $C_2$ and $C_3$ is 42 degrees, so is the angle $\theta_3$ between the +X-axis and the direct line connecting the centers $C_2$ and $C_4$. The angle $\theta_4$ between the −X-axis and the direct line connecting the centers $C_2$ and $C_5$ is 42 degrees, so is the angle $\theta_5$ between the −X-axis and the direct line connecting the centers $C_2$ and $C_6$.

Figure 1A:
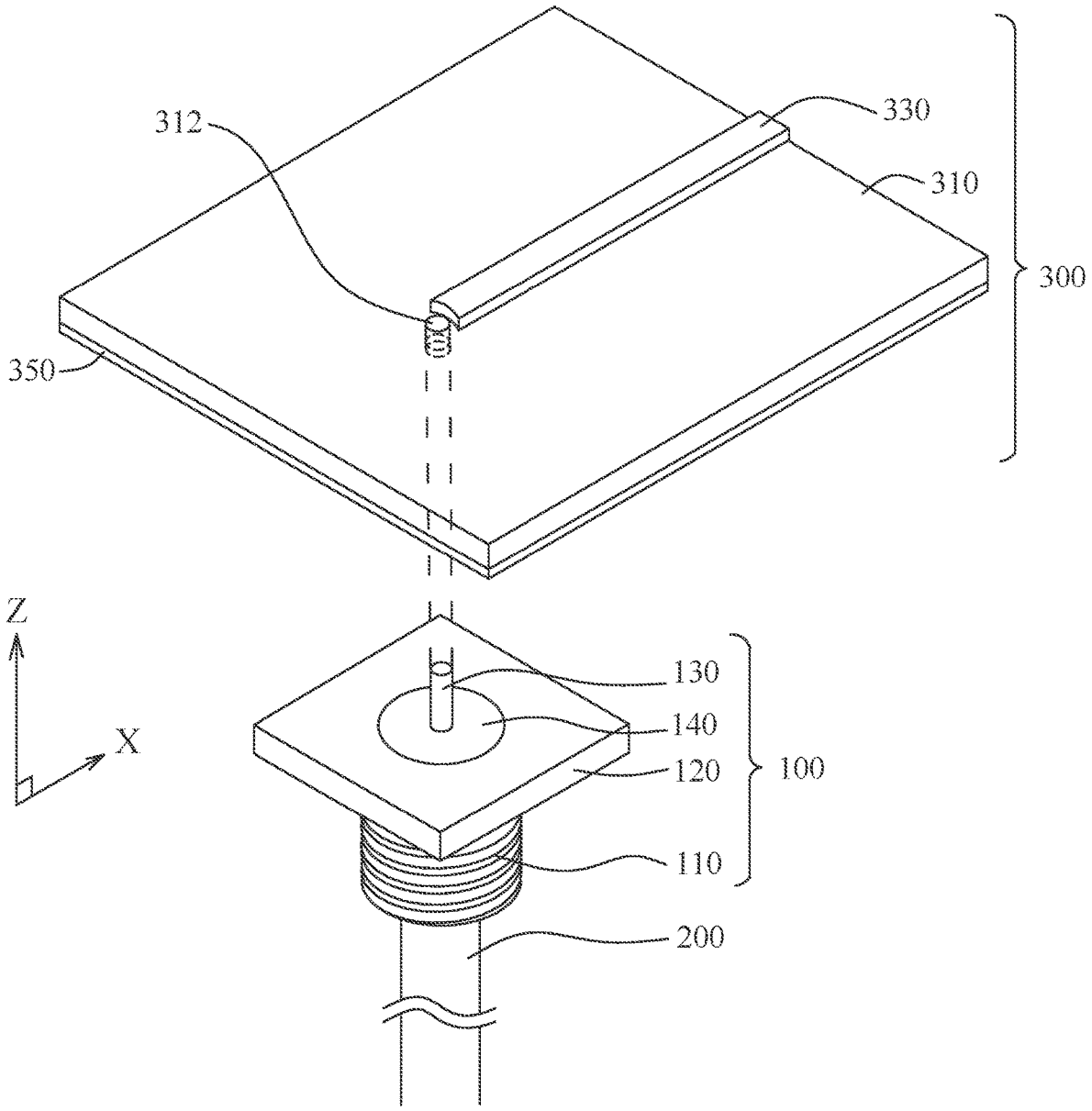
FIG. 1A (Prior Art)
FIG. 1A is the schematic view of a conventional rear-mounted vertical transition.
Figure 10:
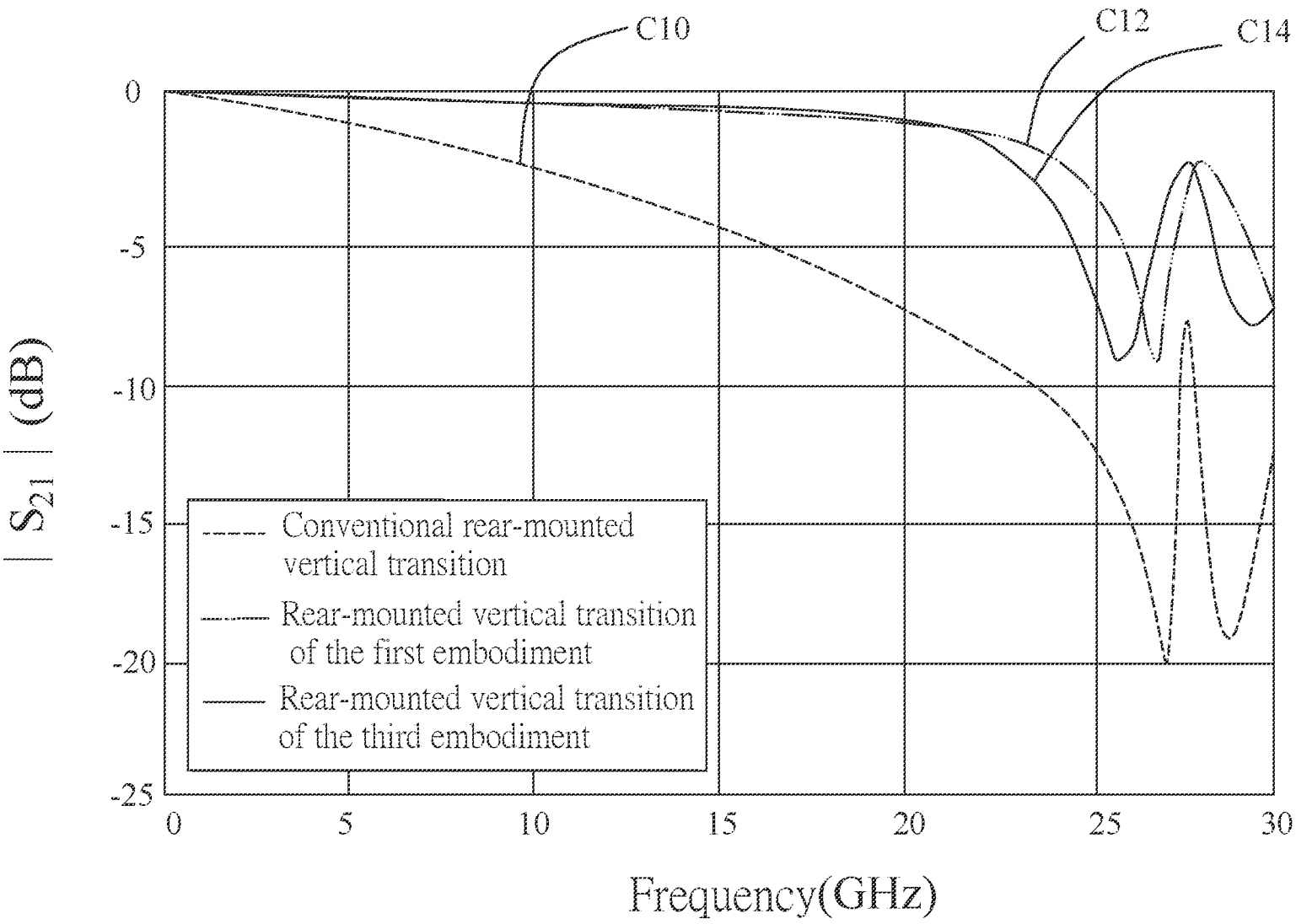
FIG. 10 is a chart comparing the frequency responses of the first and third embodiments of the present invention for rear-mounted vertical transitions to the frequency response of a conventional rear-mounted vertical transition.

FIG. 10 is a plot related to the frequency responses of three rear-mounted vertical transitions, which compares the $|S_{21}|$ responses of the first and third embodiments of the present invention to the $|S_{21}|$ response of the conventional rear-mounted vertical transition. The curve C10 in FIG. 10 shows that the upper limit of the 1-dB passband of the conventional rear-mounted vertical transition shown in FIG. 1A is 5.5 GHz. Compared to FIG. 1A, the curve C12 shows that the rear-mounted vertical transition shown in FIG. 3 exhibits an upper limit of 18.8 GHz for the 1-dB passband, which amounts to an increase of about 342% on the 1-dB passband. For the rear-mounted vertical transition shown in FIG. 8, the curve C14 exhibits an upper limit of 18.2 GHz for its 1-dB passband, which is increased by about 331% compared to the 1-dB passband of the conventional rear-mount vertical transition.

Figure 1B:
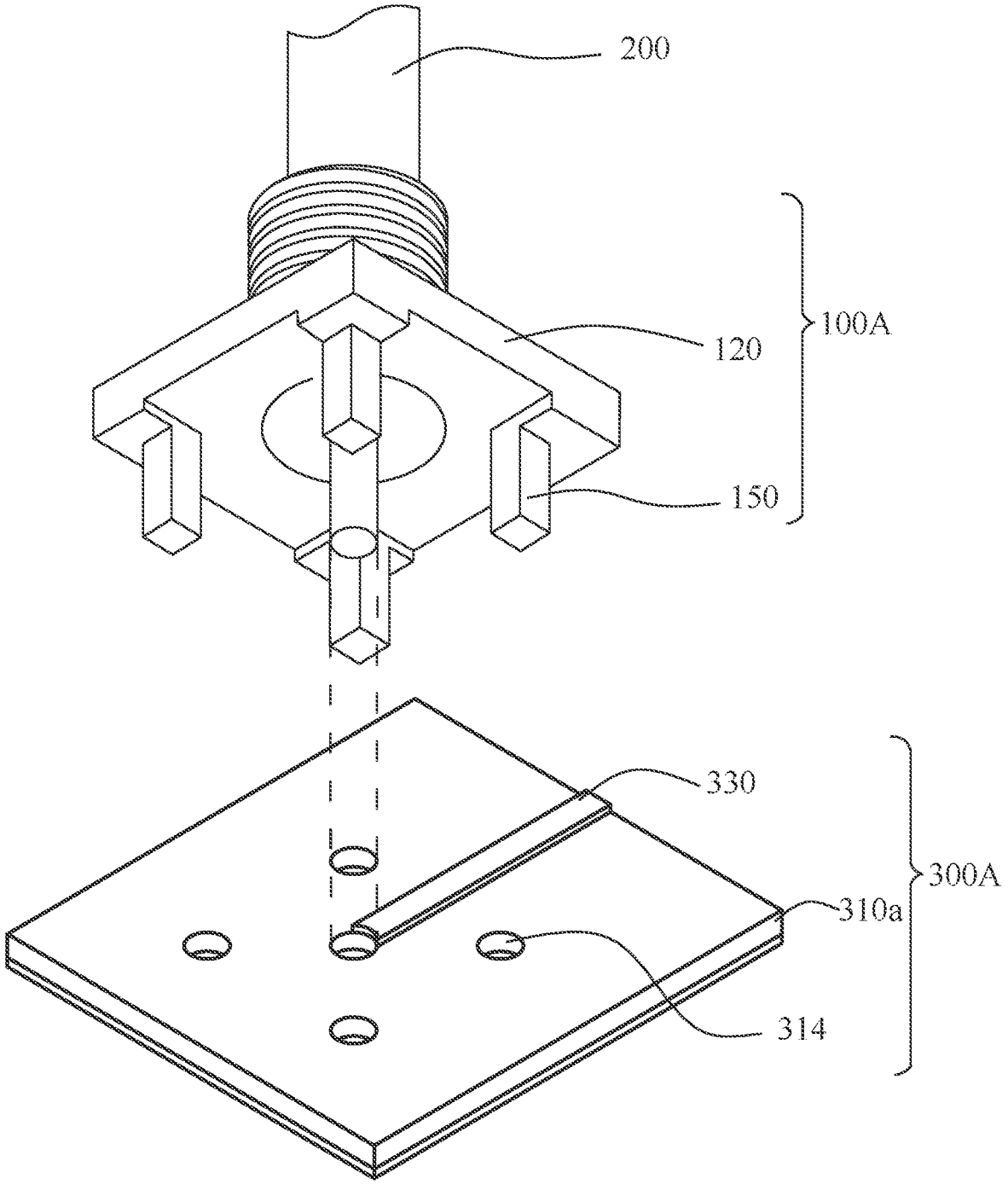
FIG. 1B (Prior Art)
FIG. 1B is the schematic view of a conventional top-mounted vertical transition.
Figure 2A:
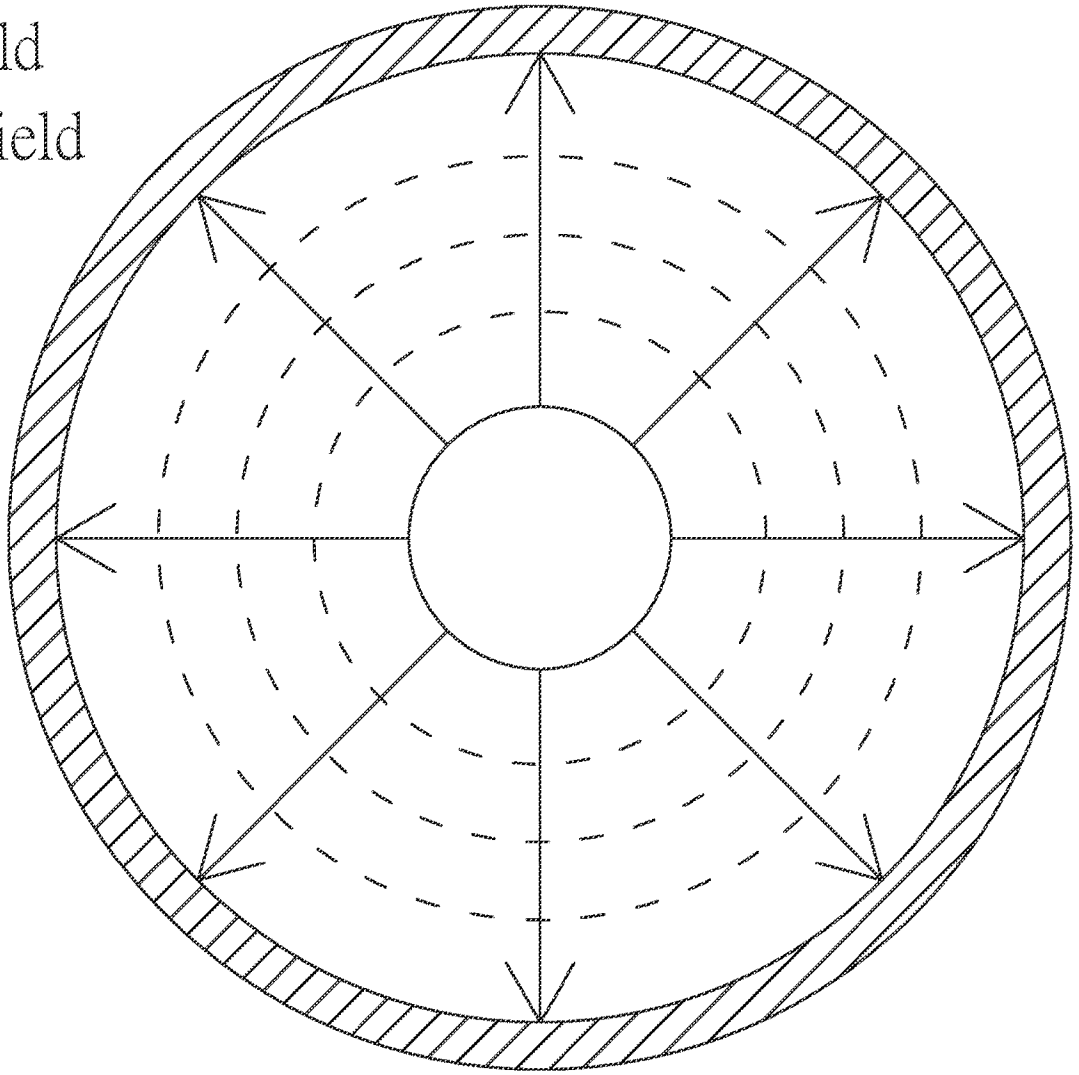
FIG. 2A (Prior Art)
FIG. 2A is the cross-sectional view of the electromagnetic field distributions within a coaxial structure.
Figure 2B:
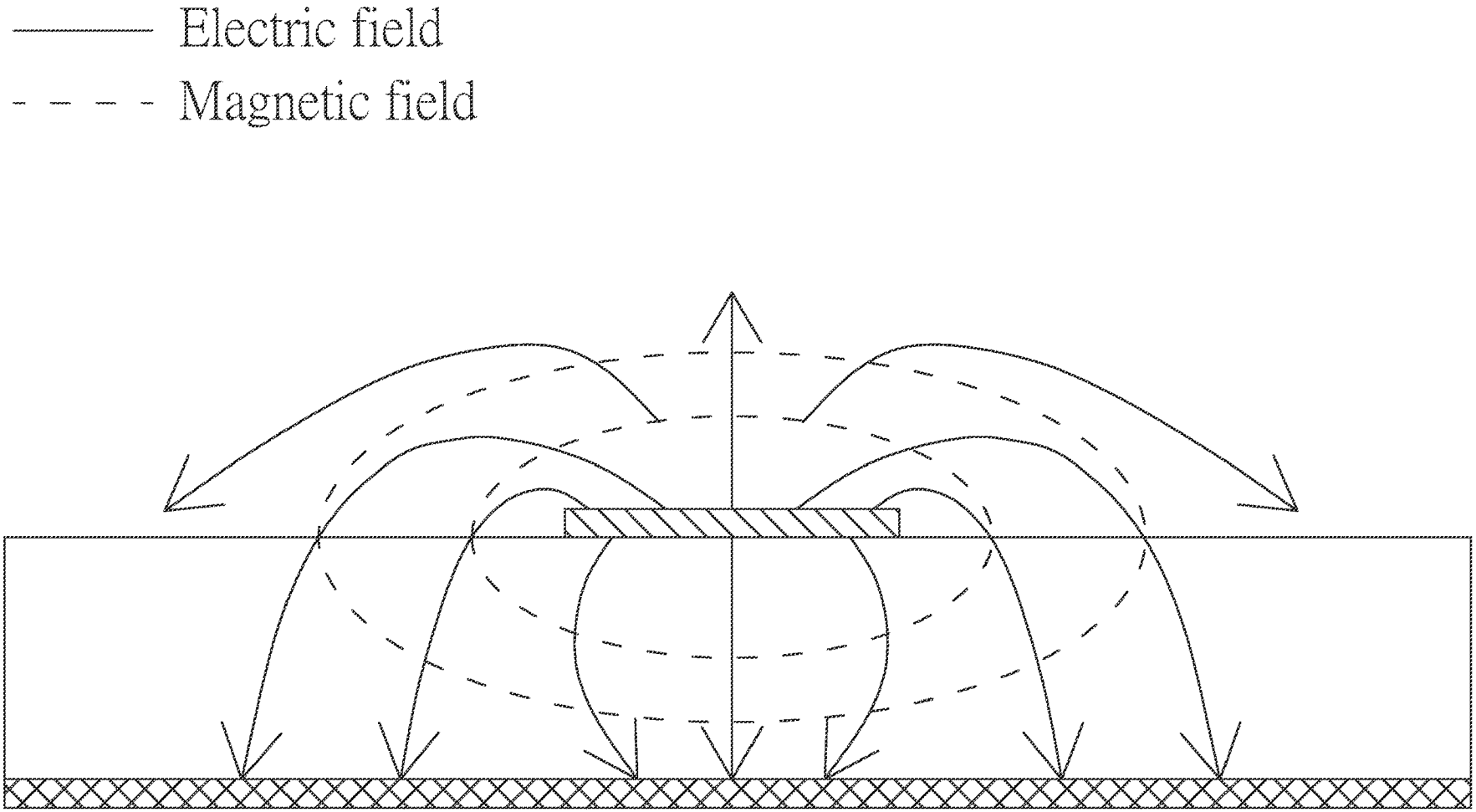
FIG. 2B (Prior Art)
FIG. 2B is the transverse view of the electromagnetic field distributions of a microstrip line.
Figure 11:
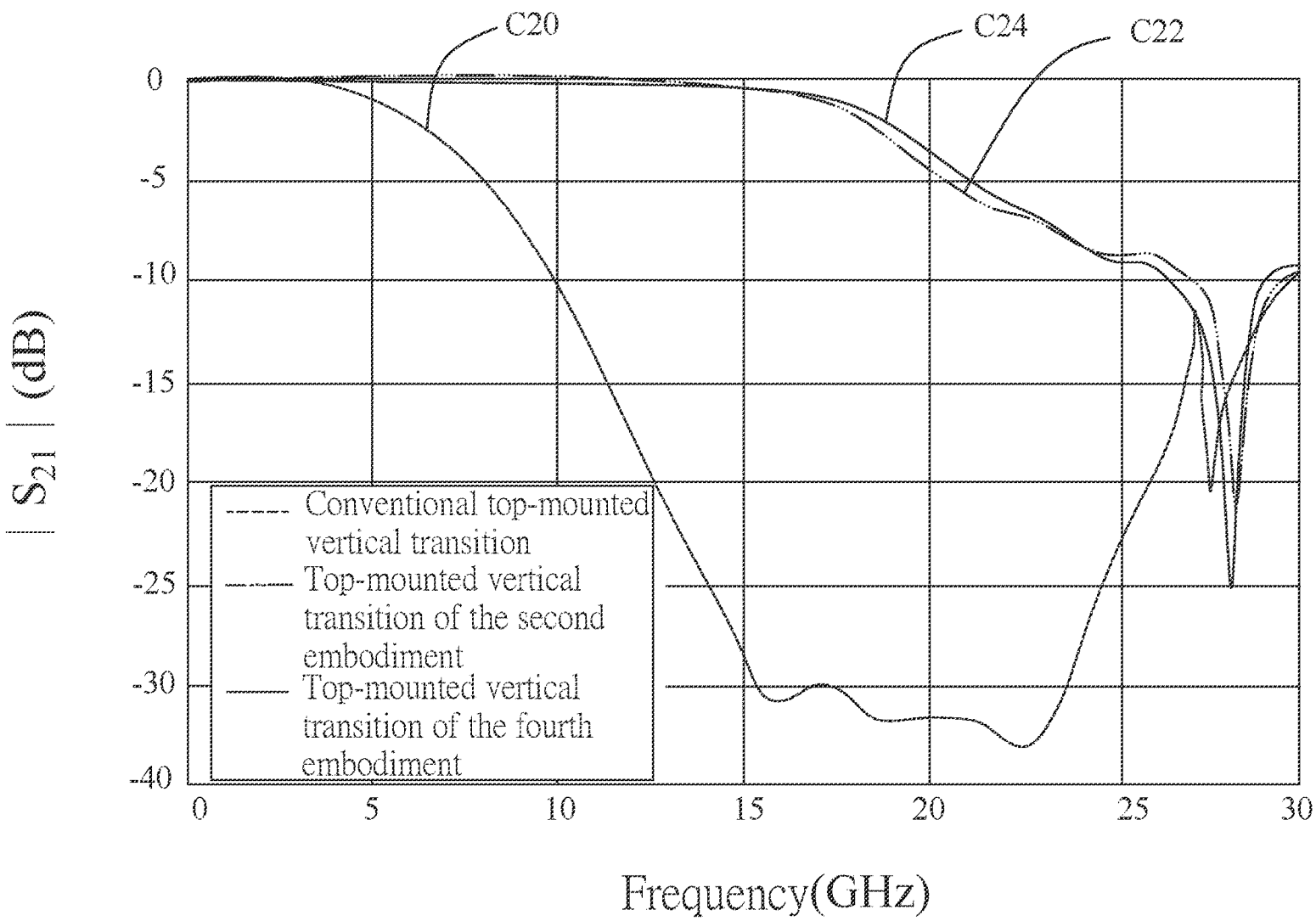
FIG. 11 is a chart comparing the frequency responses of the second and fourth embodiments of the present invention for top-mounted vertical transitions to the frequency response of a conventional top-mounted vertical transition.

FIG. 11 is a plot related to the frequency responses of three top-mounted vertical transitions, which compares the $|S_{21}|$ responses of the second and fourth embodiments of the present invention to the $|S_{21}|$ response of the conventional top-mounted vertical transition. The curve C20 in FIG. 11 shows that the upper limit of the 1-dB passband of the conventional top-mounted vertical transition shown in FIG. 1B is 4.8 GHz. Compared to FIG. 1B, the curve C22 shows that the top-mounted vertical transition shown in FIG. 4 exhibits an upper limit of 16.4 GHz for the 1-dB passband, which amounts to an increase of about 342% on the 1-dB passband. For the top-mounted vertical transition shown in FIG. 9, the curve C24 exhibits an upper limit of 16.7 GHz for its 1-dB passband, which is increased by about 348% compared to the 1-dB passband of the conventional top-mounted vertical transition.

The present invention is directed to a new method for a vertical transition between a coaxial structure and a microstrip line. Compared with the conventional vertical transition, the present invention may reduce the insertion loss at higher frequencies, decrease the influence of the resonance response, greatly increase the 1-dB passband, and provide an easy way to assemble and to fix the center conductor. Through the characteristic analysis on the vertical transition between the two transmission lines, it is confirmed that the vertical transition of the present invention may generally apply to the designs in which the coaxial connector is placed below or above the microstrip line, may also apply to different types of coaxial connectors, and may be suitable for microstrip lines with substrates of different thicknesses and dielectric constants. Its applications vary over a wide range, however, it is more significant for the integration of high-frequency systems in microwave engineering or measurements for high-frequency components. According to the method of the present invention, the frequency responses of the vertical transition are not severely affected by errors in the fabrication processes of the coaxial connector and the planar transmission line. In summary, the present invention conforms to patent requirements such as industrial utilization, novelty, and advancement.

The foregoing descriptions of the preferred embodiments of the present invention have been provided for the purposes of illustration and explanations. It is not intended to be exclusive or to confine the invention to the precise form or to the disclosed exemplary embodiments. Accordingly, the foregoing descriptions should be regarded as illustrative rather than restrictive. Obviously, many modifications and variations will be apparent to professionals skilled in this art. The embodiments are chosen and described in order to best explain the principles of the invention and its best mode for practical applications, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated.

Therefore, the term "the invention", "the present invention" or the like is not necessary to confine the scope defined by the claims to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules on the requirement of an abstract for the purpose of conducting survey on patent documents, and should not be used to interpret or limit the scope or meaning of the claims. Any advantages and benefits described hereto may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method for a vertical transition between a coaxial structure and a microstrip line, comprising:

providing the microstrip line and the coaxial structure, wherein the microstrip line comprises a substrate, a signal line and a ground plane, the substrate having an upper surface and a lower surface opposite to the upper surface, the signal line being deposited on the upper surface, the ground plane being deposited on the lower surface, wherein the coaxial structure comprises a center conductor with an unwrapped end;

having a portion of the ground plane removed to become a slot right below one end of the signal line;

creating a plurality of through holes in the substrate and overlapping the slot, the plurality of through holes including a transition hole and at least one second through hole, wherein the transition hole is next to the end of the signal line, the transition hole and the slot establish a first eccentric configuration, and the at least one second through hole and the slot establish a second eccentric configuration; and managing an extended direction of the unwrapped end of the center conductor and an extended direction of the signal line to be perpendicular to each other, and directly inserting the unwrapped end of the center conductor through the transition hole to electrically connect the unwrapped end of the center conductor to the end of the signal line, wherein the at least one second through hole is maintained in a hollow state while the unwrapped end of the center conductor is electrically connected to the end of the signal line through the transition hole.

2. The method according to claim 1, wherein the slot is a circular slot, the method further comprising:

dividing an area of the circular slot into a first sectorial region and a second sectorial region, wherein the first sectorial region exhibits an extended angle less than 180 degrees, and the second sectorial region exhibits an extended angle greater than 180 degrees;

creating the transition hole in the first sectorial region; and hollowing out the entire second sectorial region to generate the at least one second through hole.

3. The method according to claim 2, wherein an edge of the second sectorial region is established by a circular-curve edge with two ends respectively connected to one end of a first straight edge and one end of a second straight edge, and the other ends of the first and the second straight edges connected to each other, the method further comprising:

modifying a corner defined by the connection of the circular-curve edge and the first straight edge into a first rounded corner; and modifying a corner defined by the connection of the circular-curve edge and the second straight edge into a second rounded corner.

4. The method according to claim 1, wherein the microstrip line comprises a ground-plane side and an upper side opposite to each other, the method further comprising:

placing a metallic ring against an inner wall of the transition hole and electrically connecting the metallic ring to the signal line;

having the unwrapped end of the center conductor penetrate through the transition hole from the upper side of the microstrip line; and having the unwrapped end of the center conductor soldered to the metallic ring from the ground-plane side of the microstrip line to electrically connect the center conductor to the signal line.

5. The method according to claim 4, wherein the coaxial structure comprises a mounting wall with four corners, the method comprising:

adding one pillar to each of the four corners of the mounting wall, wherein each of the pillars comprises a base connected to the mounting wall, and the base exhibits a thickness greater than a thickness of the signal line;

creating four mounting holes in the substrate and outside the slot; and having the four pillars correspondingly penetrate the four mounting holes from the upper side of the microstrip line, and then soldering a penetrating end of each of the pillars onto the ground plane.

6. The method according to claim 1, further comprising:

attaching a second substrate under the ground plane;

creating a plurality of third through holes in the second substrate to correspond to the transition hole and the at least one second through hole in the substrate on a one-to-one basis;

depositing a second ground plane to the second substrate from a lower side of the second substrate; and removing a portion of the second ground plane to create a second slot to correspond to the slot in the ground plane.

7. The method according to claim 1, wherein the slot is a circular slot, and the at least one second through hole comprises multiple second through holes, the method further comprising:

creating the multiple second through holes overlapping the circular slot, wherein the multiple second through holes include a round-end rectangular through hole and two circular through holes; and creating the transition hole between the two circular through holes.

8. The method according to claim 1, further comprising: creating the at least one second through hole as a hole with an edge comprising a circular-curve edge and three connected straight edges making three sides of a rectangle.

9. The method according to claim 1, further comprising: creating the at least one second through hole as a C-figure through hole.

10. The method according to claim 1, wherein the coaxial structure comprises a mounting wall, and the microstrip line comprises a ground-plane side, the method further comprising:

having the unwrapped end of the center conductor penetrate through the transition hole from the ground-plane side of the microstrip line; and attaching the mounting wall onto the ground plane.

* * * * *